US006244046B1

(12) United States Patent
Yamashita

(10) Patent No.: US 6,244,046 B1
(45) Date of Patent: Jun. 12, 2001

(54) ENGINE EXHAUST PURIFICATION SYSTEM AND METHOD HAVING NOX OCCLUDING AND REDUCING CATALYST

(75) Inventor: Yukihiro Yamashita, Kariya (JP)

(73) Assignee: Denso Corporation, Aichi (JP)

( * ) Notice: Subject to any disclaimer, the term of this patent is extended or adjusted under 35 U.S.C. 154(b) by 0 days.

(21) Appl. No.: 09/299,747

(22) Filed: Apr. 27, 1999

(30) Foreign Application Priority Data

Jul. 17, 1998 (JP) ..... 10-203574
Jul. 17, 1998 (JP) ..... 10-203575

(51) Int. Cl.[7] ..... F01N 3/00
(52) U.S. Cl. ..... 60/285; 60/277; 60/297; 60/276
(58) Field of Search ..... 60/276, 277, 285, 60/274, 297, 301, 286

(56) References Cited

U.S. PATENT DOCUMENTS 5,433,074 7/1995 Seto et al. .
5,437,153 * 8/1995 Takeshima et al. ..... 60/276
5,450,722 9/1995 Takeshima et al. .
5,452,576 * 9/1995 Hamburg et al. ..... 60/274
5,471,836 12/1995 Takeshima et al. .
5,473,887 12/1995 Takeshima et al. .
5,483,795 1/1996 Katoh et al. .
5,713,199 * 2/1998 Takeshima et al. ..... 60/276
5,715,679 * 2/1998 Asanuma et al. ..... 60/276
5,974,788 * 11/1999 Hepburn et al. ..... 60/274
5,983,627 * 11/1999 Asik et al. ..... 60/274
6,041,592 * 3/2000 Huynh et al. ..... 60/274

FOREIGN PATENT DOCUMENTS 10-54274 3/1989 (JP) .
8-260948 10/1996 (JP) .
8-261041 10/1996 (JP) .

OTHER PUBLICATIONS

U.S. application No. 09/166,937, Yamashita et al., filed Oct. 6, 1998.

* cited by examiner

*Primary Examiner*—Thomas Denion
*Assistant Examiner*—Binh Tran
(74) *Attorney, Agent, or Firm*—Nixon & Vanderhye P.C.

(57) ABSTRACT

A NOx catalyst is attached to an engine exhaust pipe, an A/F sensor is disposed upstream of the NOx catalyst, and an $O_2$ sensor is disposed downstream of the NOx catalyst. A CPU in an ECU executes a lean combustion control so that NOx in exhaust gases discharged at the time of the lean combustion is occluded by the NOx catalyst. The CPU further executes a rich combustion control temporarily, so that the occluded NOx to be discharged from the NOx catalyst. The CPU checks if the NOx catalyst deteriorates. When occurrence of deterioration is detected, the CPU increases the proportion of the rich combustion to the lean combustion, thereby increasing the temperature of the NOx catalyst. After the catalyst temperature increases, the air-fuel ratio is controlled to the stoichiometric air-fuel ratio to regenerate the NOx catalyst.

3 Claims, 21 Drawing Sheets

NEW THREE-WAY CATALYST

DETERIORATED CATALYST

ENGINE EXHAUST PURIFICATION SYSTEM AND METHOD HAVING NOX OCCLUDING AND REDUCING CATALYST

CROSS REFERENCE TO RELATED APPLICATION

This application relates to and incorporates herein by reference Japanese Patent Applications No. 10-203574 and No. 10-203575, both being filed on Jul. 17, 1998.

BACKGROUND OF THE INVENTION

1. Field of the Invention

The present invention relates to an exhaust purification system and method for an internal combustion engine, which is applied to an air-fuel ratio control system of an internal combustion engine for performing a lean combustion at a lean air-fuel ratio, and has a NOx occluding and reducing catalyst for purifying nitrogen oxides (NOx) in exhaust gases emitted at the time of the lean combustion.

2. Related Art

In an air-fuel ratio control system for an internal combustion engine in recent years, a technique for performing a so-called lean combustion control for burning fuel on the lean air-fuel ratio side relative to the stoichiometric ratio in order to improve the fuel consumption is being used more and more. In the case of carrying out the lean combustion, exhaust gases emitted from the internal combustion engine include a large amount of NOx, so that a NOx catalyst for purifying NOx is necessary. On the other hand, since fuel and lubricating oil contain sulfur, sulfur is contained in exhaust gases emitted from the internal combustion engine and adsorbed on the NOx catalyst as well as NOx. When sulfur is adsorbed on the NOx catalyst, the NOx adsorbing power is lessened. Consequently, techniques for removing sulfur adsorbed on the NOx catalyst is proposed.

For example, when platinum Pt and barium Ba are carried on a carrier, sulfur is adsorbed on the NOx catalyst, thereby forming stable sulfate $BaSO_4$. When the amount of sulfate $BaSO_4$ on the NOx catalyst increases, the NOx occlusion amount that the NOx catalyst can occlude is gradually purified.

According to JP-A No. 10-54274, when the sulfur adsorption amount exceeds a predetermined amount, the air-fuel ratio is controlled to the rich air-fuel ratio side and a heat generation of exhaust gases is increased. As a specific means, lean misfire is caused for a predetermined period and the air-fuel ratio is controlled to the rich side after the misfire. By this operation, unburned components are discharged to the NOx catalyst and burnt in the catalyst, thereby increasing the temperature of the catalyst. As a specific second means, the air-fuel ratio is controlled to the rich side and the ignition timing is retarded, thereby increasing the temperature of exhaust gases.

The exhaust purification system of the publication has, however, the following problems. Specifically, when the lean misfire is forcefully caused, unexpected torque fluctuations occur and the drivability is lessened with the torque fluctuations. Further, it is likely that unburned components such as HC and CO are discharged into the atmosphere in association with the misfire. In the case of retarding the ignition timing, it is necessary to increase the intake air volume in order to assure an output torque. The exhaust gas amount increases in association with it, so that it is likely that a total amount of harmful components such as HC, CO, and NOx increases.

SUMMARY OF THE INVENTION

It is therefore an object of the present invention to provide an exhaust purification system and method for an internal combustion engine, which can discharge sulfur adsorbed on a catalyst while avoiding disadvantages such as torque fluctuations and increase in exhaust emission.

According an exhaust purification system and method of the present invention, an air-fuel ratio control parameter for controlling the air-fuel ratio to be alternately lean and rich and for increasing the temperature of a NOx catalyst is set variably, when NOx occlusion amount that the NOx catalyst can occlude becomes smaller than a predetermined value. The NOx catalyst is regenerated by controlling the air-fuel ratio to the stoichiometric ratio or the rich side after completion of the temperature increasing processing.

In this case, the catalyst temperature may be increased by increasing the proportion of the rich combustion control to the lean combustion control, by decreasing the time ratio (lean time/rich time) between lean combustion control and rich combustion control, or by increasing the degree of richness at the time of the rich combustion control.

According to the present invention, deterioration of the NOx catalyst is detected further. When occurrence of the deterioration of the NOx catalyst is detected, the catalyst is regenerated by controlling continuously the air-fuel ratio to a stoichiometric ratio or a richer air-fuel ratio instead of alternate lean and rich combustion control. The catalyst regeneration is limited to only when the catalyst deteriorates, so that influences on other controls such as frequent interruption in an air-fuel ratio lean combustion control can be minimized.

The catalyst deterioration may be detected in other ways, and such deterioration detection may be used independently of the catalyst regenerating operation.

BRIEF DESCRIPTION OF THE DRAWINGS

Other objects, features and advantages of the present invention will become more apparent from the following detailed description made with reference to the accompanying drawings. In the drawings.

DETAILED DESCRIPTION OF THE EXEMPLARY EMBODIMENTS

Figure 1:
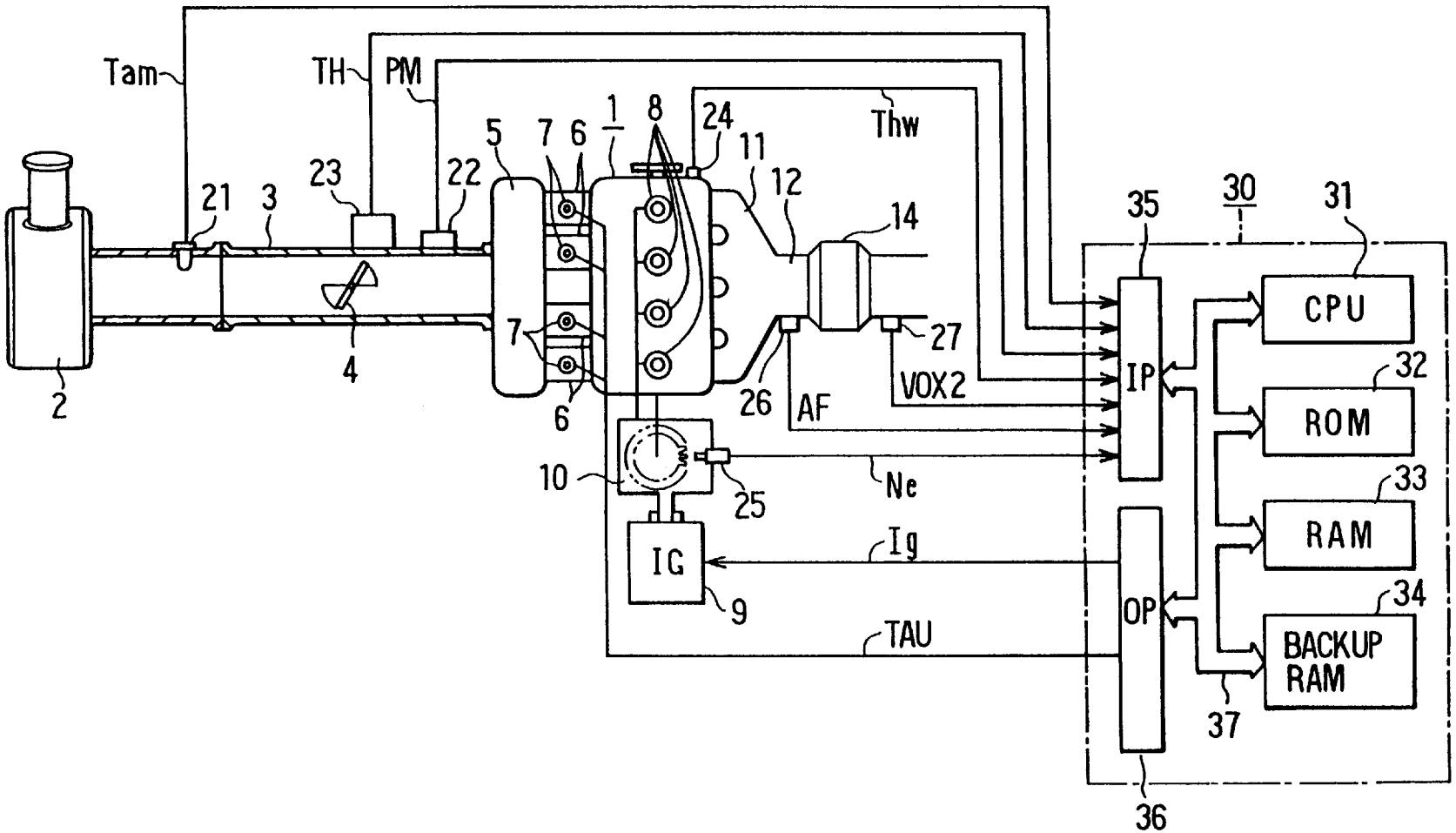
FIG. 1 is a block diagram showing a whole construction of an air-fuel ratio control system according to a first embodiment of the present invention.

In an air-fuel ratio control system of the embodiments in which the same or like reference numerals are used to designate the same or like parts, a target air-fuel ratio of mixture supplied to an internal combustion engine is set to the lean air-fuel ratio side with respect to the stoichiometric air-fuel ratio, and a lean combustion is performed on the basis of the target air-fuel ratio. That is, a lean combustion control is executed. As a main construction of the system, a NOx occluding and reducing catalyst (NOx catalyst) is provided in an exhaust system path of the internal combustion engine. A limit current type air-fuel ratio sensor (A/F sensor) is arranged at the upstream side of the NOx catalyst, and an oxygen sensor ($O_2$ sensor) is arranged at the downstream side of the same.

[First Embodiment]

Referring first to FIG. 1, an internal combustion engine is in the form of a four-cylinder four-cycle spark ignition type. Intake air passes from the upstream through an air cleaner 2, an intake pipe 3, a throttle valve 4, a surge tank 5, and an intake manifold 6 and is mixed with fuel injected from fuel injection valves 7 of respective cylinders in the intake manifold 6. The mixture is supplied at a predetermined air-fuel ratio to the respective cylinders.

A high voltage supplied from an ignition circuit 9 is distributed via a distributor 10 to a spark plug 8 provided for each cylinder in the engine 1 and the spark plug 8 ignites the mixture of each cylinder at a predetermined timing. Exhaust gas discharged from each cylinder after the mixture is burned passes through an exhaust manifold 11, an exhaust pipe 12, and a NOx catalyst 14 provided in the exhaust pipe 12 and is discharged into the atmosphere. The NOx catalyst 14 occludes NOx mainly during a combustion of lean air-fuel mixture, reduces the occluded NOx with rich components (CO, HC and the like) during a combustion of rich air-fuel ratio mixture, and discharges the resultant gas.

The intake pipe 3 is provided with an intake temperature sensor 21 and an intake pressure sensor 22. The intake temperature sensor 21 senses temperature of intake air (intake air temperature Tam), and the intake pressure sensor 22 senses vacuum pressure in the intake pipe (intake air pressure PM) downstream of the throttle valve 4. The throttle valve 4 is provided with a throttle sensor 23 for sensing opening angle of the throttle valve 4 (throttle opening angle TH). The throttle sensor 23 generates an analog signal according to the throttle opening angle TH. The throttle sensor 23 has therein an idle switch and generates a detection signal indicating that the throttle valve 4 is generally closed.

A cylinder block of the engine 1 is provided with a coolant temperature sensor 24. The coolant temperature sensor 24 senses temperature of coolant water (coolant water temperature Thw) circulating in the engine 1. The distributor 10 is provided with a rotational speed sensor 25 for sensing rotational speed of the engine 1 (engine rotational speed Ne). The rotational speed sensor 25 generates 24 pulse signals at equal intervals every two rotations of the engine 1, that is, every 720° CA.

Further, the limit current type A/F sensor 26 is arranged at the upstream side of the NOx catalyst 24 in the exhaust pipe. The sensor 16 generates a wide-area linear air-fuel ratio signal in proportional to the oxygen concentration in exhaust gases discharged from the engine 1 (or CO concentration of unburned gasses). The $O_2$ sensor 27 is arranged at the downstream side of the NOx catalyst 14 of the exhaust pipe 12. The sensor 27 generates an electromotive force signal (VOX2), which varies depending on whether the air-fuel ratio of the exhaust gas is rich or lean.

The ECU 30 is constructed as a logical operating unit whose main components are a CPU 31, a ROM 32, a RAM 33, a backup RAM 34 and the like, and are connected to an input port 35 for receiving detection signals from the sensors and an output port 36 for outputting control signals to the actuators and the like via a bus 37. The ECU 30 receives detection signals (intake air temperature Tam, intake air pressure PM, throttle opening angle TH, coolant temperature Thw, engine speed Ne, air-fuel ratio signal, and the like) from the various sensors via the input port 35. The ECU 30 generates control signals such as a fuel injection amount TAU and an ignition timing Ig on the basis of the detection values and outputs the control signals to the fuel injection valve 7, the ignition circuit 9, and the like via the output port 36.

Figure 2:
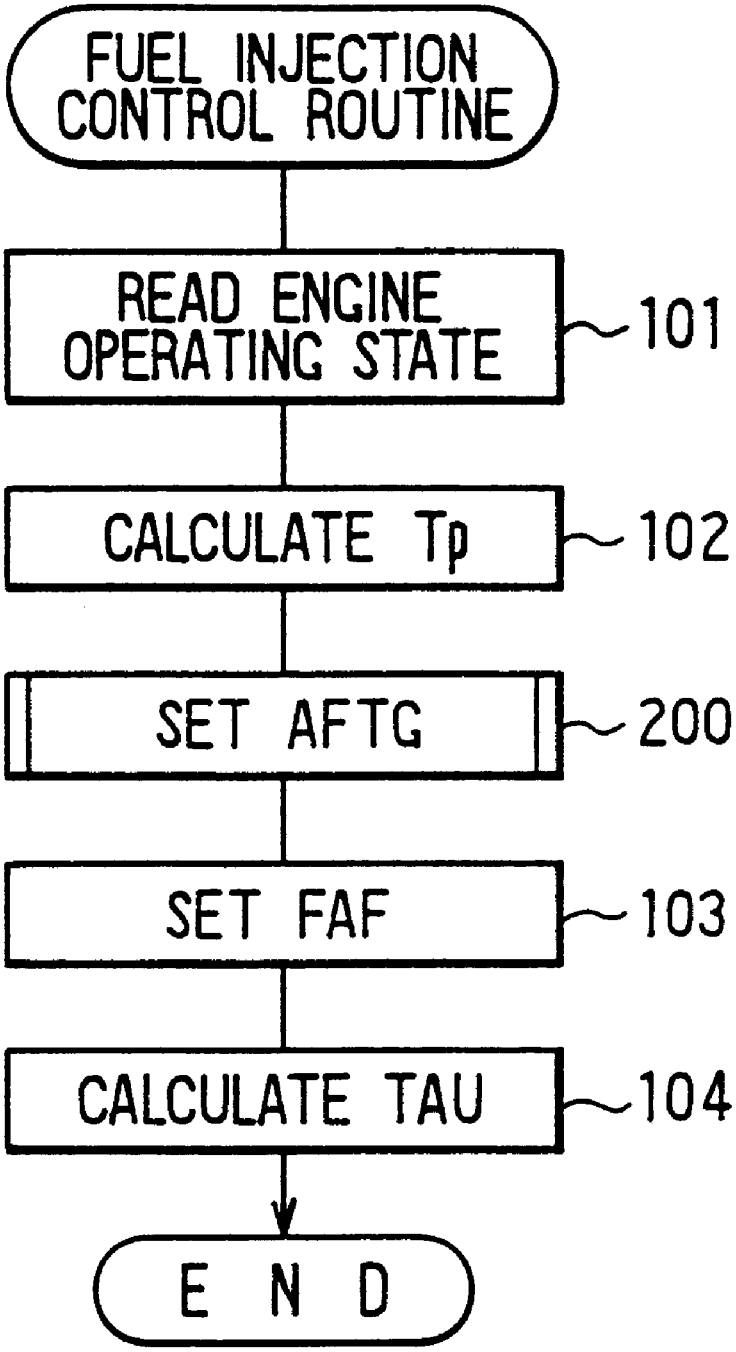
FIG. 2 is a flow diagram showing a fuel injection control routine in the first embodiment.

The CPU 31 executes a fuel injection control routine shown in FIG. 2. This routine is executed at every fuel injection of each cylinder (every 180° CA).

When the routine of FIG. 2 starts, first at step 101, the CPU 31 reads detection results of the sensors (engine speed Ne, intake air pressure PM, coolant temperature Thw, and the like) representing the engine operating state and, at step 102, calculates a basic injection amount Tp according to the engine speed Ne and the intake air pressure PM on each occasion by using a basic injection map preliminarily stored in the ROM 32. The CPU 31 also sets at step 200 a target air-fuel ratio AFTG based on a routine shown in FIG. 3, which is described later.

After that, at step 103, the CPU 31 sets the air-fuel ratio correction factor FAF on the basis of a deviation between an actual air-fuel ratio AF (measurement value of the sensor) and the target air-fuel ratio AFTG. In the embodiment, the air-fuel ratio F/B control is executed based on the advanced control theory. For instance, the FAF value is set based on the known processing, which is disclosed in JP-A 1-110853, etc.

After setting the FAF value, the CPU 31 calculates the final fuel injection amount TAU from the basic injection amount Tp, the air-fuel ratio correction factor FAF, and other correction factors FALL (various correction factors such as coolant temperature, air-conditioner load and the like).

$$TAU=Tp \cdot FAF \cdot FALL$$

After calculating the fuel injection amount TAU, the CPU 31 outputs a control signal corresponding to the TAU value to the fuel injection valve 7 and ends the routine.

Here, the above F/B control is executed when the F/B conditions are satisfied, while the air-fuel ratio open-loop control is executed (FAF=1.0) when the F/B conditions are not satisfied. The F/B conditions are satisfied when the coolant temperature Tw is above a predetermined temperature, the engine 1 is neither at high speed nor at high load, the A/F sensor 26 is in activated state and the like.

The target air-fuel ratio AFTG setting routine (processing at step 200) will be described with reference to the flow diagram shown in FIG. 3. In this processing, the target air-fuel ratio AFTG is properly set so that a rich combustion is carried out temporarily during the execution of the lean combustion. More specifically, according to the embodiment, a lean time TL and a rich time TR are set to a predetermined ratio on the basis of a value of a period counter PC calculated at every fuel injection. The lean combustion and the rich combustion are alternately performed according to the time TL and TR.

Figure 3:
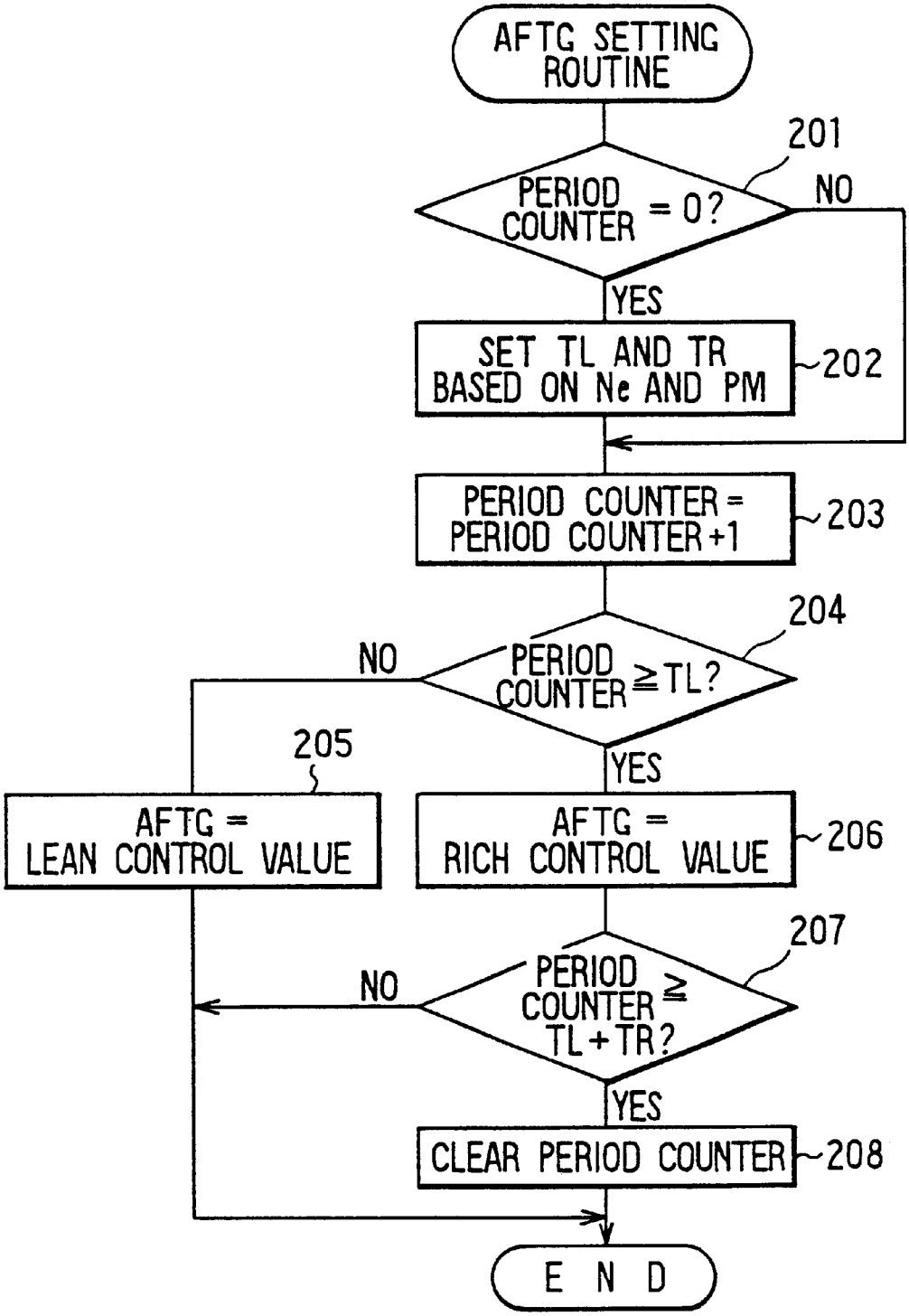
FIG. 3 is a flow diagram showing a routine of setting a target air-fuel ratio in the first embodiment.

In the processing of FIG. 3, the CPU 31 determines first, at step 201, whether the period counter PC at that time is "0" or not. On condition that the period counter PC=0, the CPU 31 sets at step 202 the lean time TL and the rich time TR on the basis of the engine speed Ne and the intake pressure PM. If the determination at step 201 is NO, (period counter PC≠0), the CPU 31 skips the processing of step 202.

Figure 4:
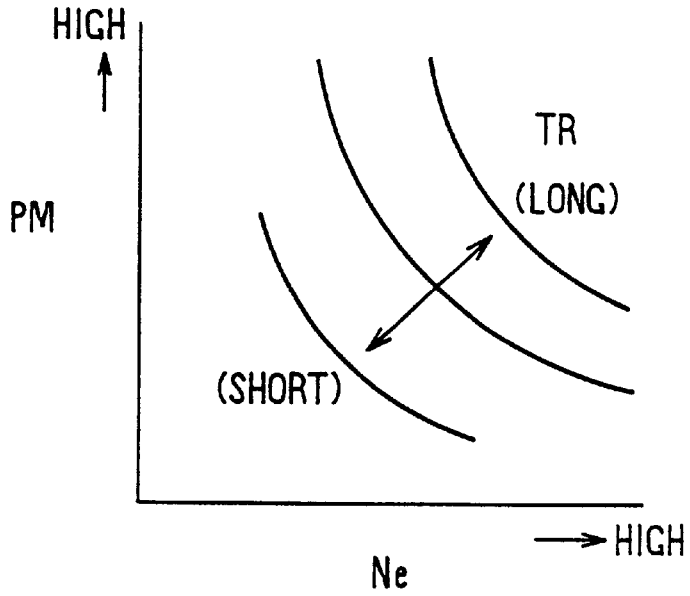
FIG. 4 is a map for setting rich time in accordance with engine operating state.

In this case, the lean time TL and the rich time TR correspond to the number of fuel injection times at the lean air-fuel ratio and the number of fuel injection times at the rich air-fuel ratio, respectively. Basically, those are set so that the higher the engine speed Ne or the intake pressure PM is, the longer the time is. In the embodiment, the rich time TR is determined by a map retrieval based on the relation of FIG. 4. In contrast to the setting of the rich time TR, the lean time TL can be determined from the rich time TR and a predetermined coefficient $\alpha$ as follows.

$$TL=TR \cdot \alpha$$

It is sufficient to set the coefficient as a fixed value of about 50. The coefficient $\alpha$ can be also variably set according to the engine operating conditions such as engine speed Ne and intake air pressure PM.

After that, the CPU 31 increments the period counter PC by "1" at step 203. In the following step 204, whether or not the value of the period counter PC has reached a value corresponding to the lean time TL is determined. When the period counter PC<TL, the CPU 31 advances to step 205 and sets the target air-fuel ratio AFTG as a lean control value based on the engine speed Ne and the intake pressure PM at that time. After setting the AFTG value, the CPU 31 ends this routine and returns to the original routine of FIG. 2.

Figure 5:
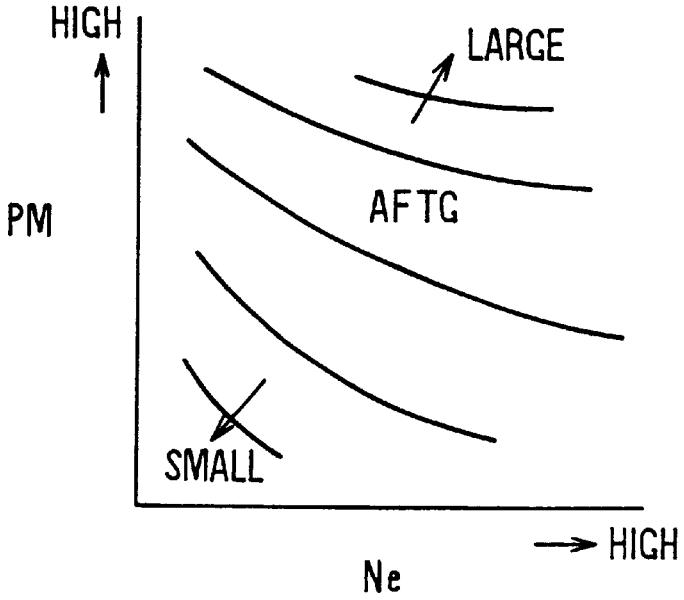
FIG. 5 is a map for setting a lean target air-fuel ratio in accordance with the engine operating state.

The AFTG value is determined, for instance, by a data retrieval from the target air-fuel ratio map shown in FIG. 5. The AFTG value may be set to A/F=20–30, for instance (however, the AFTG value is set to around the stoichiometric ratio when the lean combustion execution condition is not satisfied, that is, the engine is not in the normal operating condition, for instance). In this instance, the air-fuel ratio is controlled to the lean side by the AFTG value set at step 205.

When the period counter PC≧TL, the CPU 31 advances to step 206 and sets the target air-fuel ratio AFTG as a rich control value. The AFTG value may be a fixed value within the rich area, or may be set variably by the map data retrieval based on the engine speed Ne or the intake pressure. In case of the map retrieval, the AFTG value is set so that the richness is increased as the engine speed or the intake pressure PM increases.

After that, the CPU 31 determines at step 207 whether or not the value of the period counter PC has reached a value corresponding to the total value "TL+TR" of the lean time TL and the rich time TR. When the period counter PC<TL+TR, the processing ends and returns to the original routine of FIG. 2. In such a case, the air-fuel ratio is controlled to be rich by the AFTG value set at step 206.

On the other hand, when the period counter PC≧TL+TR and step 207 determines YES, the CPU 31 clears the period counter PC to "0" at step 208 and then ends this routine to return to the original routine of FIG. 2. In association with the clearing of the period counter PC, step 201 determines YES at the time of the next processing. Thus, the lean time TL and the rich time TR are newly set. The lean and rich air-fuel ratio controls are performed again on the basis of the lean time TL and rich time TR.

Figure 6:
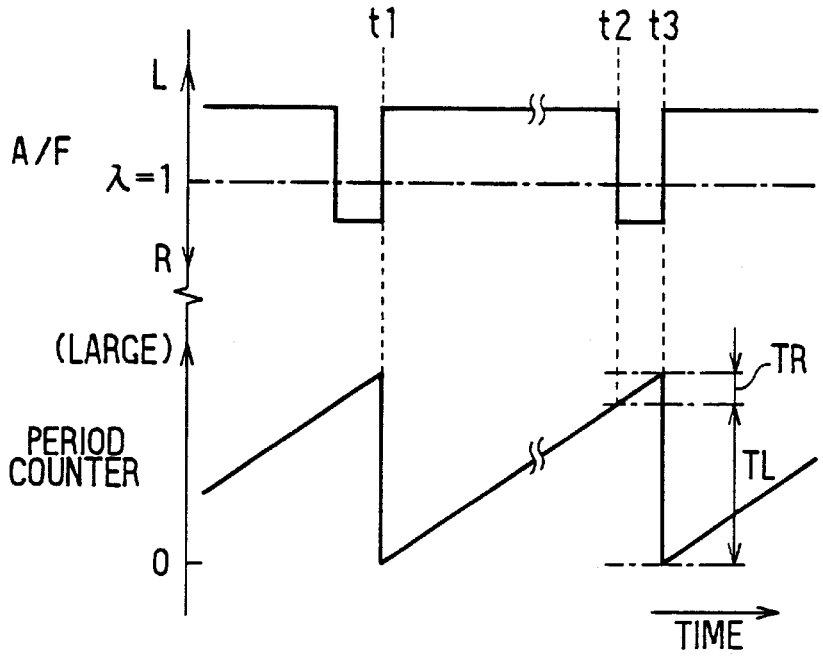
FIG. 6 is a timing diagram showing the operation of the air-fuel ratio control in the first embodiment.

As shown in FIG. 6, in a period from time t1 to t2 (period in which a periodic counter is from 0 to TL), the air-fuel ratio is controlled to be lean and NOx in exhaust gases is occluded by the NOx catalyst 14. In a period from time t2 to t3 (period in which the periodic counter is from TL to TL+TR), the air-fuel ratio is controlled to be rich and NOx occluded by the NOx catalyst 14 is purified and discharged by unburned gas components (HC, CO) in the exhaust gases. In this manner, the lean combustion control and the rich combustion control of the air-fuel ratio are repeated in accordance with the lean time TL and the rich time TR.

In the first embodiment, NOx purification ratio (=NOx purification amount/NOx inflow amount) is obtained from the ratio between the NOx purification amount by the NOx catalyst 14 and the NOx inflow amount to the catalyst 14, and the deterioration of the NOx catalyst 14 is sensed according to the NOx purification ratio.

The "NOx purification amount" can be obtained as an actual rich gas amount required to purify NOX. In such a case, the difference between the rich gas inflow amount and a surplus gas amount is obtained by monitoring the air-fuel ratios downstream and upstream of the NOx catalyst at the time of the rich combustion. The NOx purification amount is obtained from the difference between the rich gas inflow amount and the surplus gas amount. In practice, a rich gas integrated value AFAD (rich gas inflow amount) by adding up outputs AF of the A/F sensor 26 upstream of the catalyst and the rear $O_2$ sensor output integrated value VOX2AD (surplus gas amount) by adding up outputs VOX2 (for convenience, referred to as "rear $O_2$ sensor output") of the $O_2$ sensor 27 downstream of the catalyst 14 at the time of the rich combustion. The difference between the rich gas integrated value AFAD and the rear $O_2$ sensor output integrated value VOX2AD is used as a NOx purification amount (=AFAD−VOX2AD).

The "NOx inflow amount" can be obtained as a NOx amount supplied to the NOx catalyst 14. In practice, the NOx integrated amount CNOXAD as a NOx inflow amount is calculated on the basis of the engine operating state (Ne, PM, and A/F) at the time of the lean combustion.

The calculation result of (AFAD−VOX2AD)/CNOXAD is used as the "NOx purification ratio" and the deterioration of the NOx catalyst 14 is sensed by using the NOx purification ratio as a deterioration determining parameter.

Figure 7:
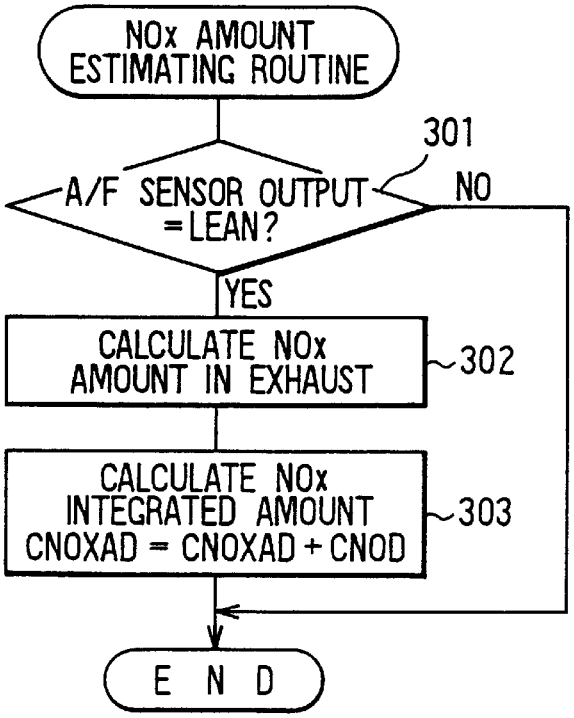
FIG. 7 is a flow diagram showing a NOx amount estimating routine in the first embodiment.
Figure 9:
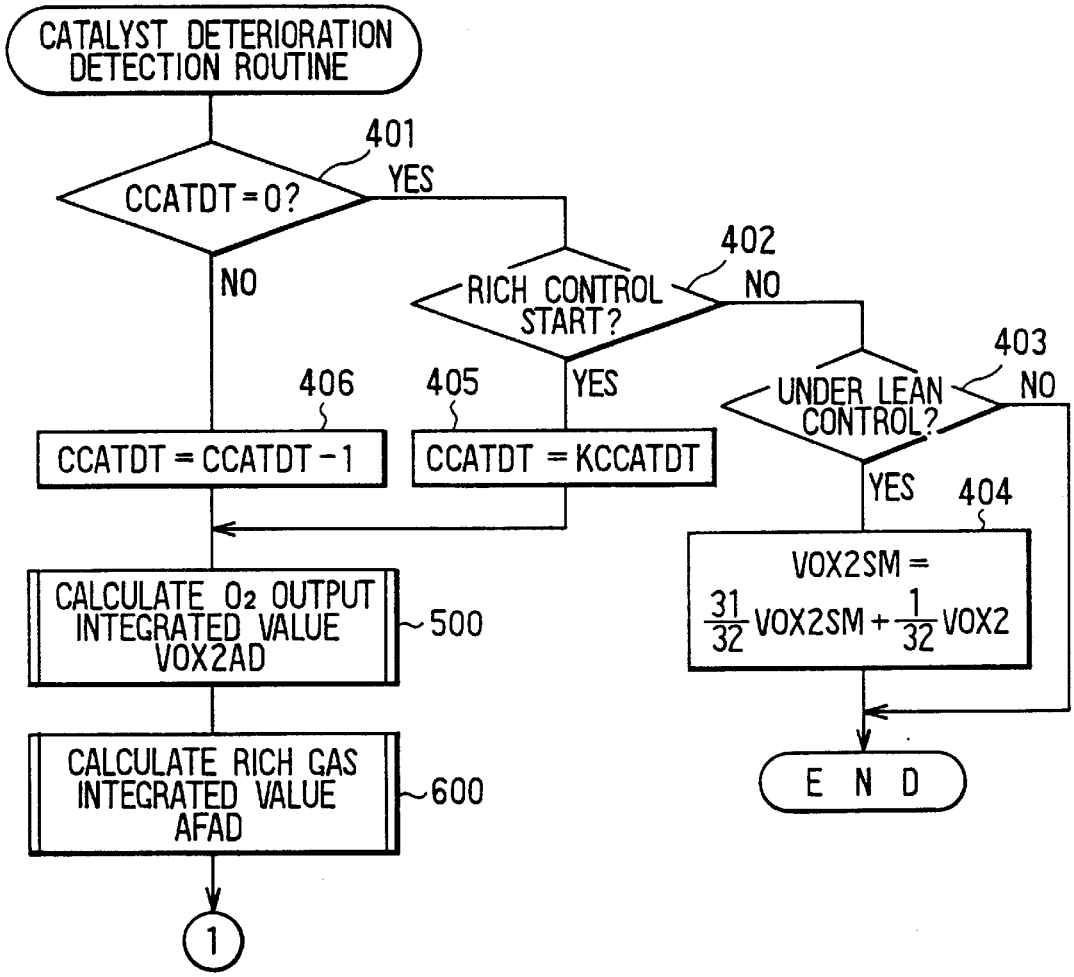
FIG. 9 is a part of flow diagram showing a catalyst deterioration detecting routine in the first embodiment.
Figure 10:
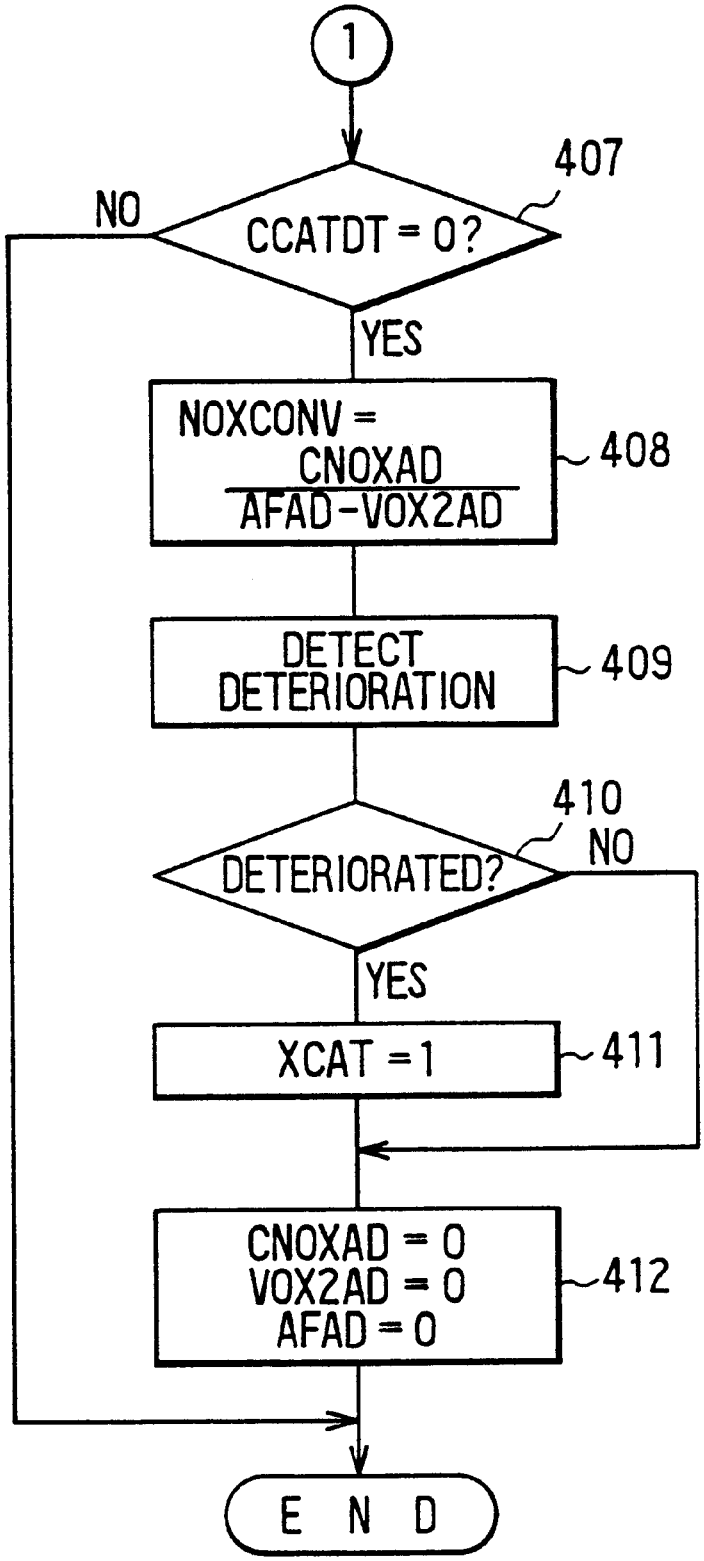
FIG. 10 is another part of the catalyst deterioration detecting routine.

The control operation of the CPU 31 relating to the detection of deterioration of the NOx catalyst 14 will be described by using the flow diagrams of FIG. 7 and FIGS. 9 to 12. FIG. 7 shows the processing of estimating the NOx integrated value of the NOx catalyst 14. FIGS. 9 and 10 show the processing of sensing the catalyst deterioration.

In FIG. 7, at step 301, the CPU 31 determines whether the present output AF (air-fuel ratio on the upstream side of the catalyst) of the A/F sensor 26 is a lean value or not. On condition of YES at step 301, the CPU 31 advances to step 302. At step 302, the CPU 31 estimates a NOx amount CNOX (mol) contained in the exhaust gases on the basis of the engine operation state. For the estimation of the CNOX value, the NOx basic amount according to the engine speed Ne and the intake pressure PM on each occasion is obtained, for example, by using the map of FIG. 8A, and an A/F correction value according to the air-fuel ratio on each occasion is obtained by using the relation of FIG. 8B. The NOx basic amount is multiplied by the A/F correction amount and the product is used as a CNOX value (CNOX= NOx basic amount A/F correction value).

Figure 8A:
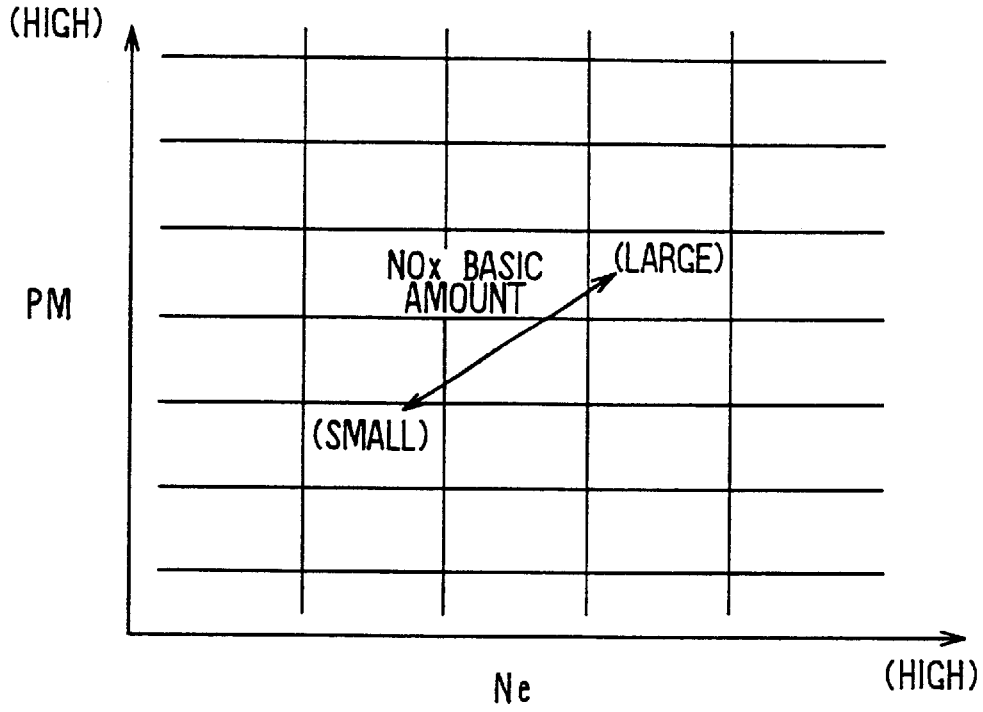
FIGS. 8A and 8B are relational diagrams used to calculate the NOx amount.
Figure 8B:
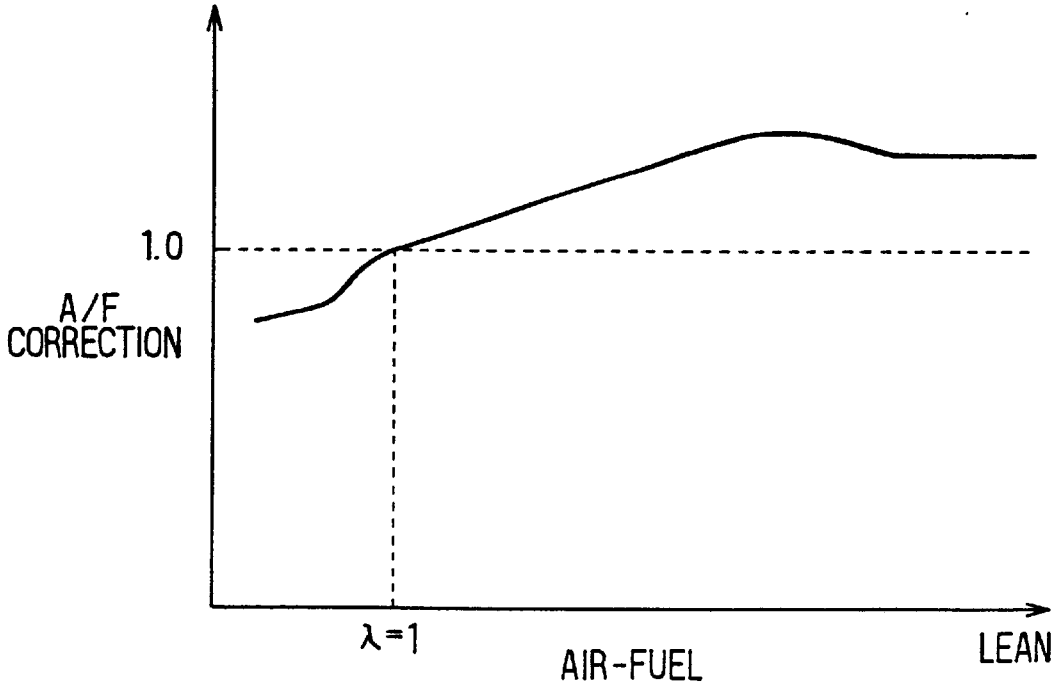

In FIG. 8A, the higher the engine speed Ne is or the higher the intake pressure PM is, the NOx basic amount is set to a larger value. In FIG. 8B, the A/F correction value=1.0 is set at the stoichiometric air-fuel ratio ($\lambda$=1) and the A/F correction value which is equal to or larger than "1.0" is set on the lean side with respect to the stoichiometric ratio. Since the combustion temperature decreases on the lean side of a certain air-fuel ratio (for example, A/F>16), the correction on the increase side becomes unnecessary and the A/F correction value is converged to a predetermined value.

After that, the CPU 31 calculates the NOx integrated amount CNOXAD at step 303. At this time, the CNOX value calculated at step 302 is added to the previous CNOXAD value and the sum is used as a CNOXAD value of this time (CNOXAD=CNOXAD+CNOX).

On the other hand, in the catalyst deterioration detection routine of FIG. 9, the CPU 31 determines whether a counter CCATDT is "0" or not at step 401. On condition that CCATDT=0, the CPU 31 advances to step 402. The CPU 31 determines whether it is the timing of the rich combustion control start or not at step 402.

If NO at step 402, the CPU 31 proceeds to step 403 and determines whether or not it is during the lean combustion control at present. When it is during the lean combustion control, the CPU 31 calculates an output smoothed value VOX2SM from the rear $O_2$ sensor output VOX2 at step 404 by using the following equation.

$$VOX2SM=(31/32)VOX2SM+(1/31)VOX2$$

If YES at step 402, the CPU 31 advances to step 405 and sets a predetermined value "KCCATDT" to the counter CCATDT. It is sufficient that the predetermined value "KCCATDT" is about three times as long as the rich time TR. When the predetermined value KCCATDT is set, NO is determined at step 401 from the next time on. The CPU 31 decrements the counter "CCATDTI" by "1" at step 406 and then advances to step 500.

Figure 11:
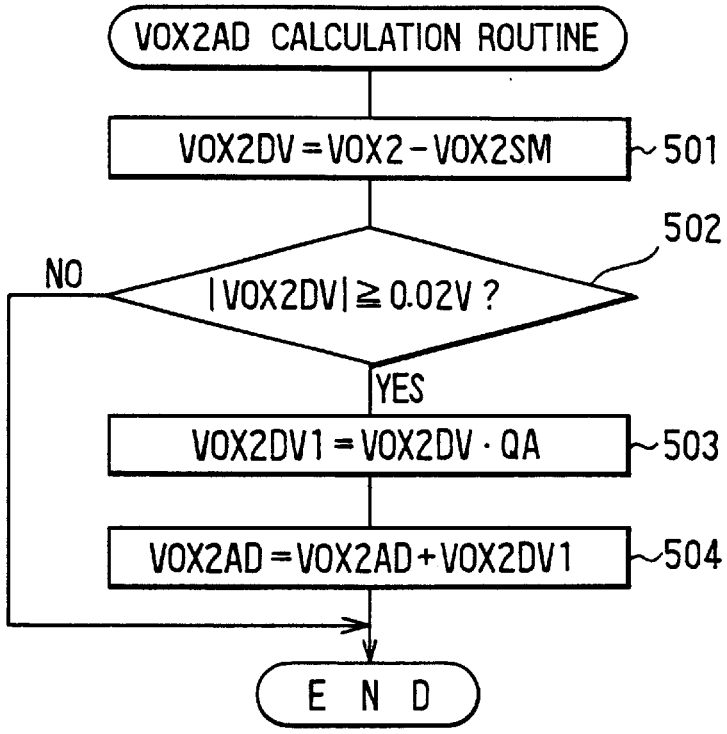
FIG. 11 is a flow diagram showing a routine of calculating a rear $O_2$ sensor output integrated value.

At step 500, the CPU 31 calculates the rear $O_2$ sensor output integrated value VOX2AD in accordance with the routine of FIG. 11, which will be described herein later. At step 600, the CPU 31 calculates the rich gas integrated value AFAD in accordance with the routine of FIG. 12 which will be described hereinbelow.

After that, the CPU 31 proceeds to step 407 in FIG. 10 and determines whether the counter CCATDT is "0" or not. If CCATDT≠0, the CPU 31 ends the routine immediately. When CCATDT becomes zero in association with the countdown at step 406, the CPU 31 advances to step 408 and calculates a deterioration determination value NOXCONV by using the following equation.

$$NOXCONV=CNOXAD/(AFAD-VOX2AD)$$

Figure 13:
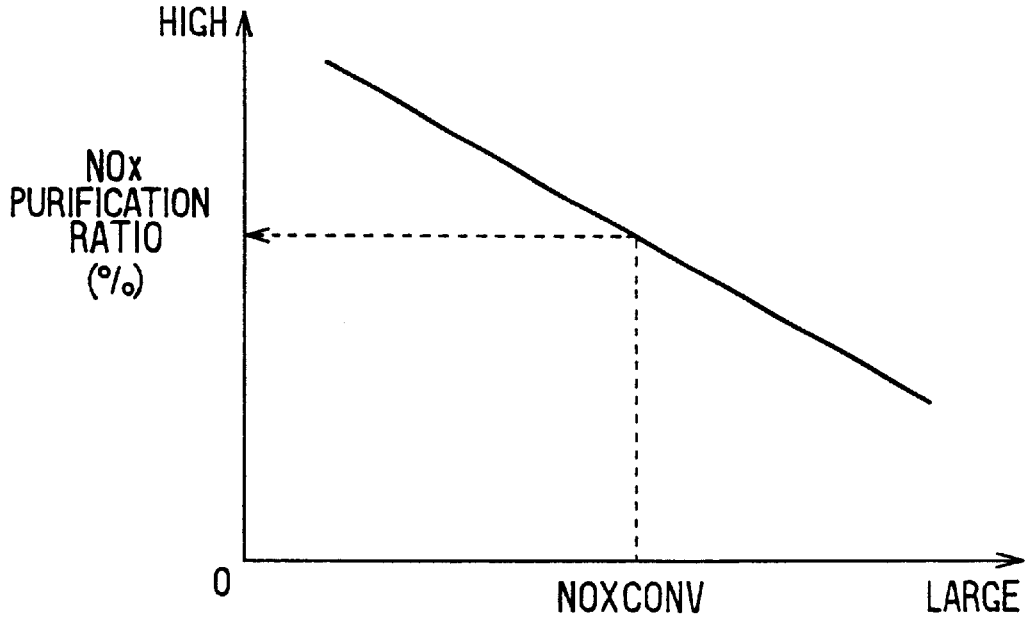
FIG. 13 is a diagram showing the relation between a deterioration determination value and a NOx purification ratio.
Figure 14:
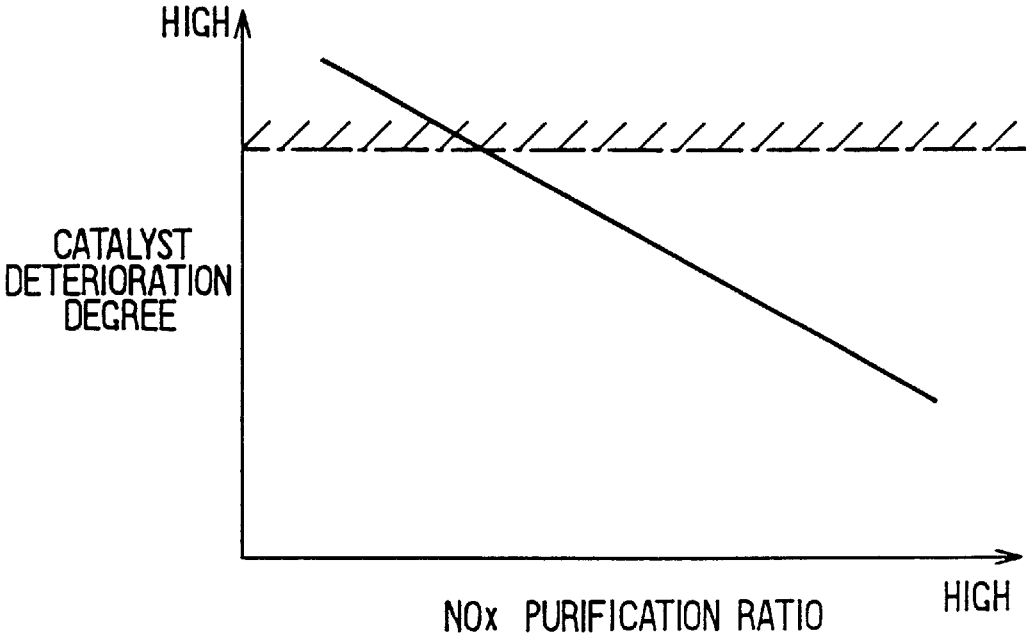
FIG. 14 is a diagram showing the relation between the NOx purification ratio and the degree of catalyst deterioration.

After that, the CPU 31 calculates the NOx purification ratio from the NOXCONV value by using the relation of FIG. 13 at step 409 and determines the degree of deterioration of the catalyst on the basis of the NOx purification ratio by using the relation of FIG. 14. In FIG. 14, the relation such that as the NOx purification ratio becomes higher, the catalyst deterioration degree becomes lower and, contrarily, as the NOx purification ratio becomes lower, the catalyst deterioration degree becomes higher. In this case, when the deterioration degree lies within a slashed line region of FIG. 14, occurrence of the deterioration is determined.

When the deterioration occurrence is determined at step 410, the CPU 31 sets "1" to the deterioration detection flag XCAT at step 411. Finally, the CPU 31 clears each of the values of CNOXAD, VOX2AD, and AFAD to "0" at step 412 and ends the routine.

The processing of calculating the rear $O_2$ sensor output integrated value VOX2AD (processing at step 500) will be described with reference to the flow diagram of FIG. 11. In the processing, first at step 501, the CPU 31 subtracts an $O_2$ output smoothed value VOX2SM (calculation value at step 404 in FIG. 9) from the rear $O_2$ output VOX2 on each occasion and uses the difference as an $O_2$ output deviation VOX2DV (VOX2DV=VOX2−VOX2SM). At step 502, the CPU 31 determines whether the absolute value of the $O_2$ output deviation VOX2DV is equal to or larger than 0.02V, that is, whether or not the rear $O_2$ sensor output VOX2 at that time has changed to the rich side more than "0.02V" from the $O_2$ output smoothed value VOX2SM measured at the time of the lean combustion.

In case of $|VOX2DV|<0.02V$ (NO at step 502), the CPU 31 ends the routine immediately and returns to the original routine of FIGS. 9 and 10. In case of $|VOX2DV|\geqq 0.02V$ (YES at step 502), at step 503, the CPU 31 calculates a "VOX2DV1 value" from the product of the $O_2$ output deviation VOX2DV and the intake air amount QA (VOX2DV1=VOX2DV·QA). The intake air amount QA is calculated based on the engine speed Ne and the intake air pressure PM on each occasion.

Further, the CPU 31 calculates the rear $O_2$ sensor output integrated value VOX2AD at step 504, ends the routine, and returns to the original routine of FIGS. 9 and 10. At step 504, the calculated VOX2DV1 value is added to the previous VOX2AD value and the sum is used as the VOX2AD value of this time (VOX2AD=VOX2AD+VOX2DV1).

Figure 12:
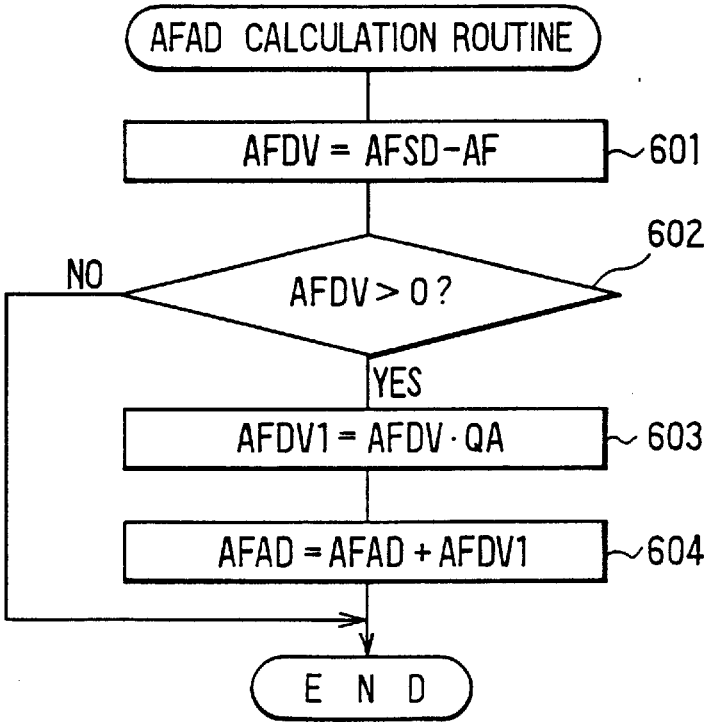
FIG. 12 is a flow diagram showing a routine of calculating a rich gas integrated value.

The processing of calculating the rich gas integrated value AFAD (processing of step 600) will be described with reference to the flow diagram of FIG. 12. In the processing, at step 601, the CPU 31 subtracts an output AF (actual air-fuel ratio) of the A/F sensor 26 from the air-fuel ratio standard AFSD (for example, the stoichiometric ratio A=1.0) and uses the difference as a rich deviation AFDV (AFDV=AFSD−AF). In the following step 602, the CPU 31 determines whether "AFDV>0" or not, that is, whether the actual air-fuel ratio AF at that time is on the rich side relative to the air-fuel ratio standard AFSD or not.

In case of AFDV≦0 (NO at step 602), the CPU 31 ends the routine immediately and returns to the original routine of FIGS. 9 and 10. In case of AFDV>0 (YES at step 602), the CPU 31 calculates a rich gas amount AFDV1 from the product of the rich deviation AFDV and the intake air amount QA (AFDVL=AFDV·QA) at step 603. Further, the CPU 31 calculates the rich gas integrated value AFAD at step 604, ends the routine, and returns to the original routine of FIGS. 9 and 10. At step 604, the calculated AFDV1 value is added to the previous AFAD value and the sum is used as the AFAD value of this time (AFAD=AFAD+AFDV1).

Figure 15:
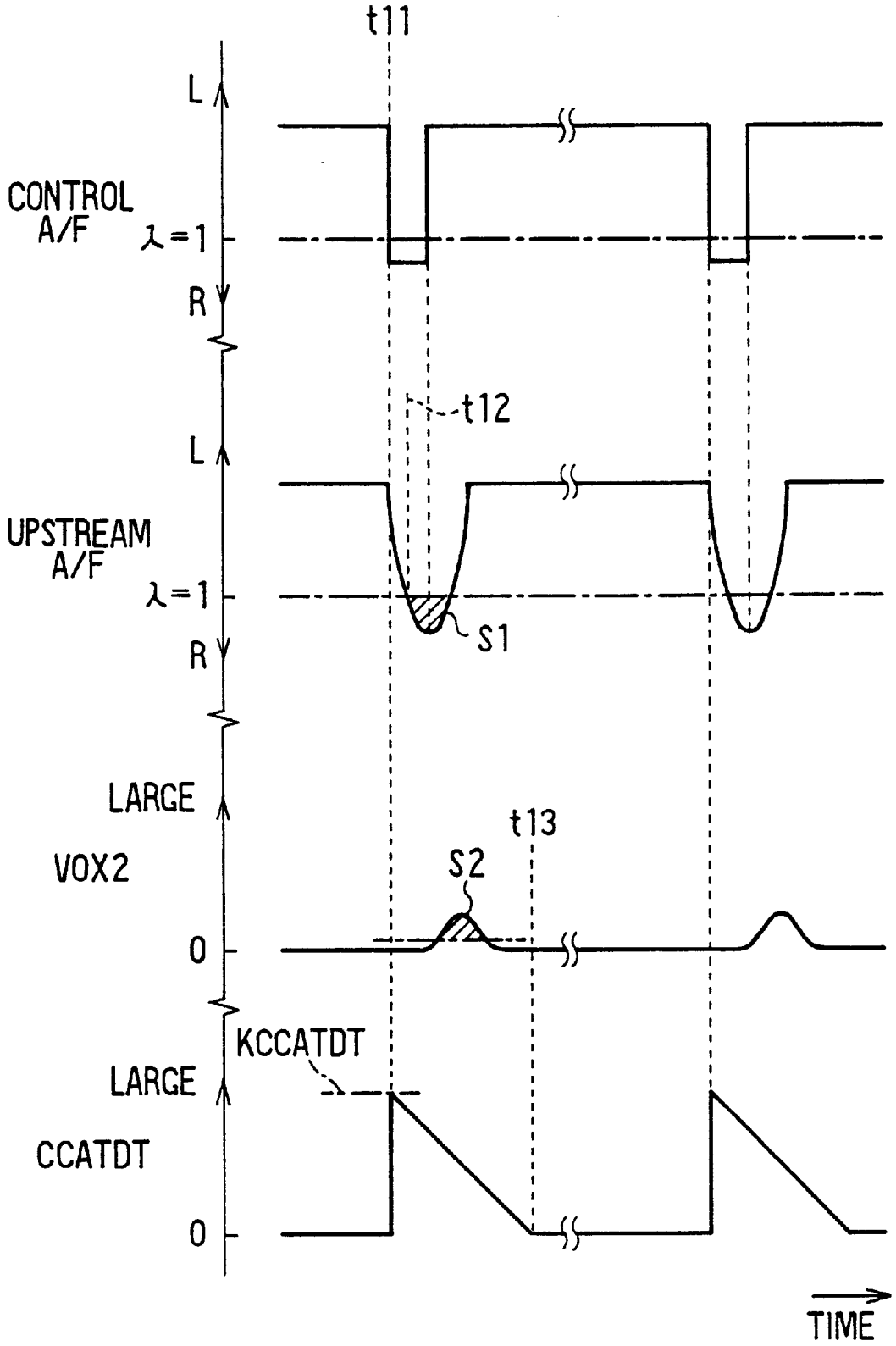
FIG. 15 is a timing diagram showing a catalyst deterioration detecting operation.

As shown in FIG. 15, before time t11, the air-fuel ratio lean combustion control is executed and the $O_2$ output smoothed value VOX2SM is calculated from the rear $O_2$ sensor output VOX2on each occasion (step 404 in FIG. 9).

At the time t11, the air-fuel ratio rich combustion control is started and the predetermined value KCCATDT is set to the counter CCATDT. The NOx integrated amount CNOXAD is calculated in the period until the air-fuel ratio on the upstream side of the catalyst becomes rich (period by time t12) (the processing of FIG. 7).

In a period from the time t11 to time t13 when the counter CCATDT becomes "0", the rich gas integrated value AFAD corresponding to a part S1 in the diagram and the rear $O_2$ sensor output integrated value VOX2AD corresponding to a part S2 in the diagram are calculated (steps 600 and 500 in FIG. 9). When CCATDT becomes "0" at time t13, the deterioration determination value NOXCONV is calculated from the CNOXAD value, the AFAD value, and the VOX2AD value and the deterioration detection is carried out according to the NOXCONV value (steps 408 and 409 in FIG. 10). After the time t13, the $O_2$ output smoothed value VOX2SM is calculated again.

In FIG. 15, when it is assumed that the deterioration of the NOx catalyst 14 becomes worse, the NOx occluding power of the catalyst 14 decreases. Consequently, the rear $O_2$ sensor output integrated value VOX2AD (part S2 in the diagram) becomes large relative to the rich gas integrated value AFAD (part S1 in the diagram). As a result, the NOx purification ratio decreases. By the decrease in the NOx purification ratio, the catalyst deterioration is detected.

When the NOx catalyst 14 is poisoned by sulfur contained in the fuel or lubricating oil, the NOx occluding power of the catalyst 14 decreases and occurrence of the deterioration is detected in the processing of FIGS. 9 and 10. In the embodiment, in order to regenerate the function of the catalyst when the deterioration of the NOx catalyst 14 is detected, the ratio of the rich combustion which is performed during the lean combustion is increased so that the temperature (catalyst temperature) of the NOx catalyst 14 rises and the stoichiometric control at the air-fuel ratio of λ=1 or a slightly rich side control is performed. When the rich components (HC, CO) are supplied to the catalyst 14 in a state where the temperature of the NOx catalyst 14 is high, sulfate BaSO4 formed by sulfur poisoning is purified, and sulfur is discharged.

Figure 16:
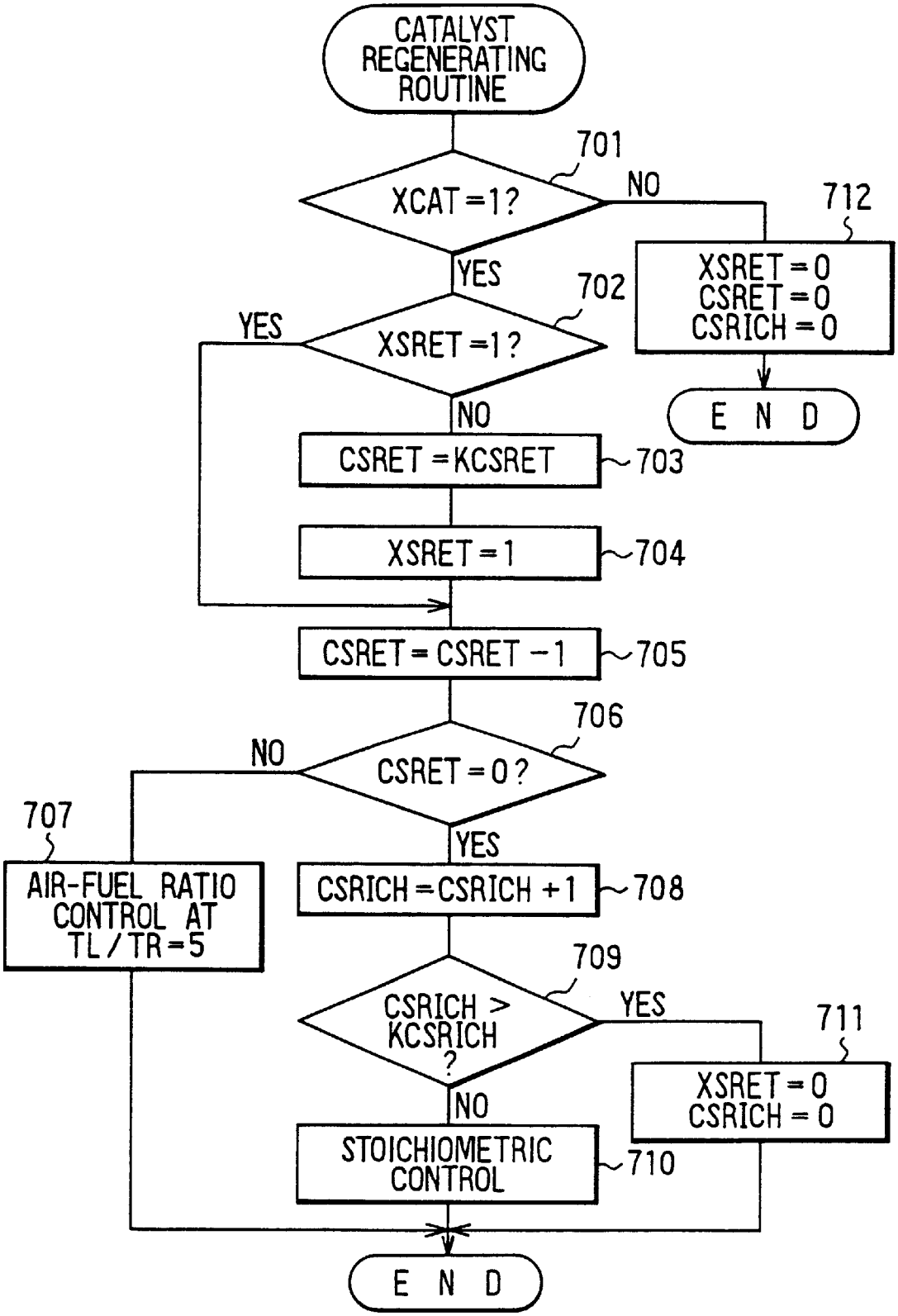
FIG. 16 is a flow diagram showing a catalyst regenerating routine in the first embodiment.

A catalyst regenerating processing is executed, for example, in one second cycle by the CPU 31 as shown in FIG. 16. First at step 701, the CPU 31 determines whether "1" is set in the deterioration detection flag XCAT or not. When the occurrence of the catalyst deterioration is detected by the processing of FIGS. 9 and 10 and XCAT=1, the CPU 31 regards that the catalyst regenerating processing is necessary, advances to step 702, and determines whether the regenerating processing flag XSRET indicating that the catalyst regenerating processing is being executed is "1" or not.

In case of XSRET=0, the CPU 31 executes steps 703 and 704 and then advances to step 705. In case of XSRET=1, the CPU 31 jumps to step 705. Specifically, in case of XSRET=0, the CPU 31 sets a predetermined value "KCSRET" to the counter CSRET at step 703 and sets "1" to the regenerating processing flag XSRET at step 704. It is sufficient that the predetermined value KCSRET is, for example, about 1 minute.

After that, the CPU 31 decrements the counter CSRET by "1" at step 705 and determines whether the counter CSRET is "0" or not at step 706. If CSRET≠0, the CPU 31 set the time ratio between the lean time and the rich time to "5:11" at step 707. In this case, by changing the time ratio between the lean time and the rich time from the normal ratio of "50:1" to "5:1", the ratio of the rich combustion is increased and the temperature of the NOx catalyst 14 gradually increases.

Figure 18:
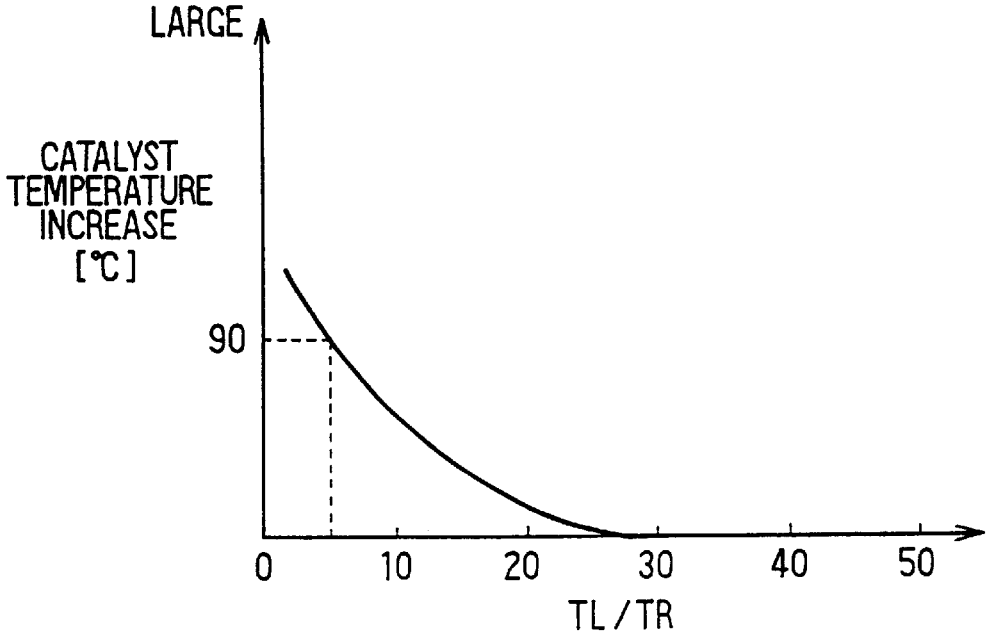
FIG. 18 is a diagram showing the relation between the lean time/rich time and the catalyst temperature rise width.

As an example, it is recognized that the "lean time/rich time" and the rise width of the catalyst temperature have the relation of FIG. 18. When the lean time/rich time is set to "5", temperature rise to about 90° C. is expected. It will be understood from FIG. 18 that the rise width of the catalyst temperature increases by increasing the proportion of the rich time.

When CSRET becomes "0" in association with the countdown of step 705, the CPU 31 advances to step 708. The CPU 31 increments another counter CSRICH by "1" at step 708 and determines whether the counter CSRICH reaches the predetermined value "KCSRICH" or not at step 709. It is sufficient that the predetermined value KCSRICH is, for example, about three minutes. If CSRICH≦KCSRICH, the CPU 31 advances to step 710 and executes the stoichiometric control with the air-fuel ratio λ=1. The air-fuel ratio can be also controlled by the slightly rich side control at step 710.

When the counter CSRICH reaches the predetermined value KCSRICH, the CPU 31 advances to step 711 and clears both the regenerating processing flag XSRET and the counter CSRICH to "0". That is, it is regarded the series of the catalyst regenerating processing has been completed and the normal air-fuel ratio control in which the time ratio between the lean time and the rich time is set to "50:1" is restarted when the regenerating processing flag XSRET is cleared.

On the other hand, in the case of NO at step 701 (XCAT=0), the CPU 31 proceeds to step 712, clears each of XSRET, CSRET, and CSRICH to "0", and ends the routine.

When the air-fuel ratio is controlled based on the processing of FIG. 16 (when steps 707 and 710 are executed), the control takes precedence over the air-fuel ratio control based on the processing of FIG. 3. For example, in the period during which "1" is set to the regenerating processing flag XSRET, a target air-fuel ratio AFTG set in FIG. 3 is invalidated and the air-fuel ratio is controlled in accordance with the processing at steps 707 and 710 in FIG. 16.

Figure 17:
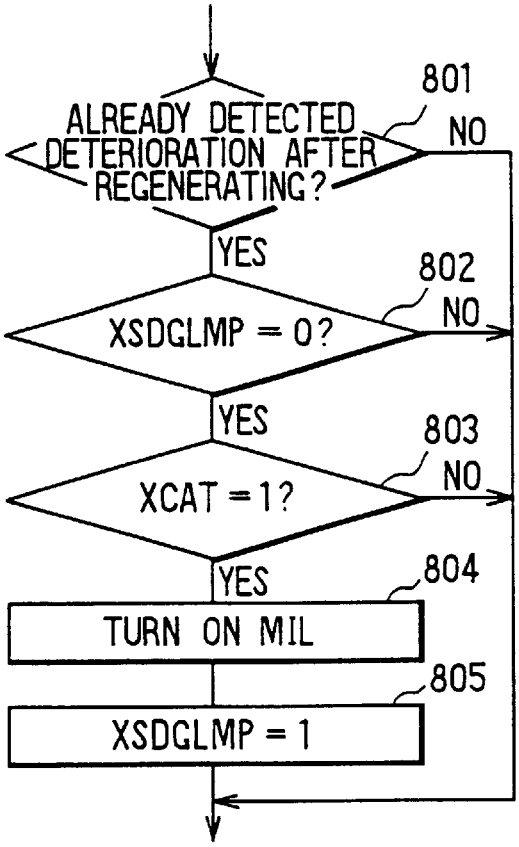
FIG. 17 is a flow diagram showing a processing which is performed after completion of the regenerating processing in the first embodiment.

After the catalyst regenerating processing in FIG. 16 is executed, in order to determine whether the sulfur poisoning is resolved by the regenerating processing or not, the processing of FIG. 17 are performed. That is, at step 801, the CPU 31 determines whether the catalyst deterioration detecting processing shown in FIGS. 9 and 10 has been performed after the regenerating processing or not. The CPU 31 determines whether a malfunction occurrence flag XSDGLMP is "0" or not at step 802. The CPU 31 determines whether the deterioration detection flag XCAT is "1" or not at step 803.

When YES in all of the steps 801 to 803, the CPU 31 advances to step 804. The CPU 31 turns on the MIL (malfunction indicator light) to warn the driver of occurrence of a malfunction at step 804 and sets "1" to the malfunction occurrence flag XSDGLMP at step 805. Specifically, irrespective of the regenerating processing in FIG. 16, when the deterioration state of the NOx catalyst 14 is continuously detected, the catalyst 14 is regarded as un-regenerable and occurrence of a malfunction is determined finally. When the occurrence of a malfunction is determined at last, the lean combustion control after that is inhibited and the control at the stoichiometric ratio (for example, $\lambda$=1) is performed.

Figure 19:
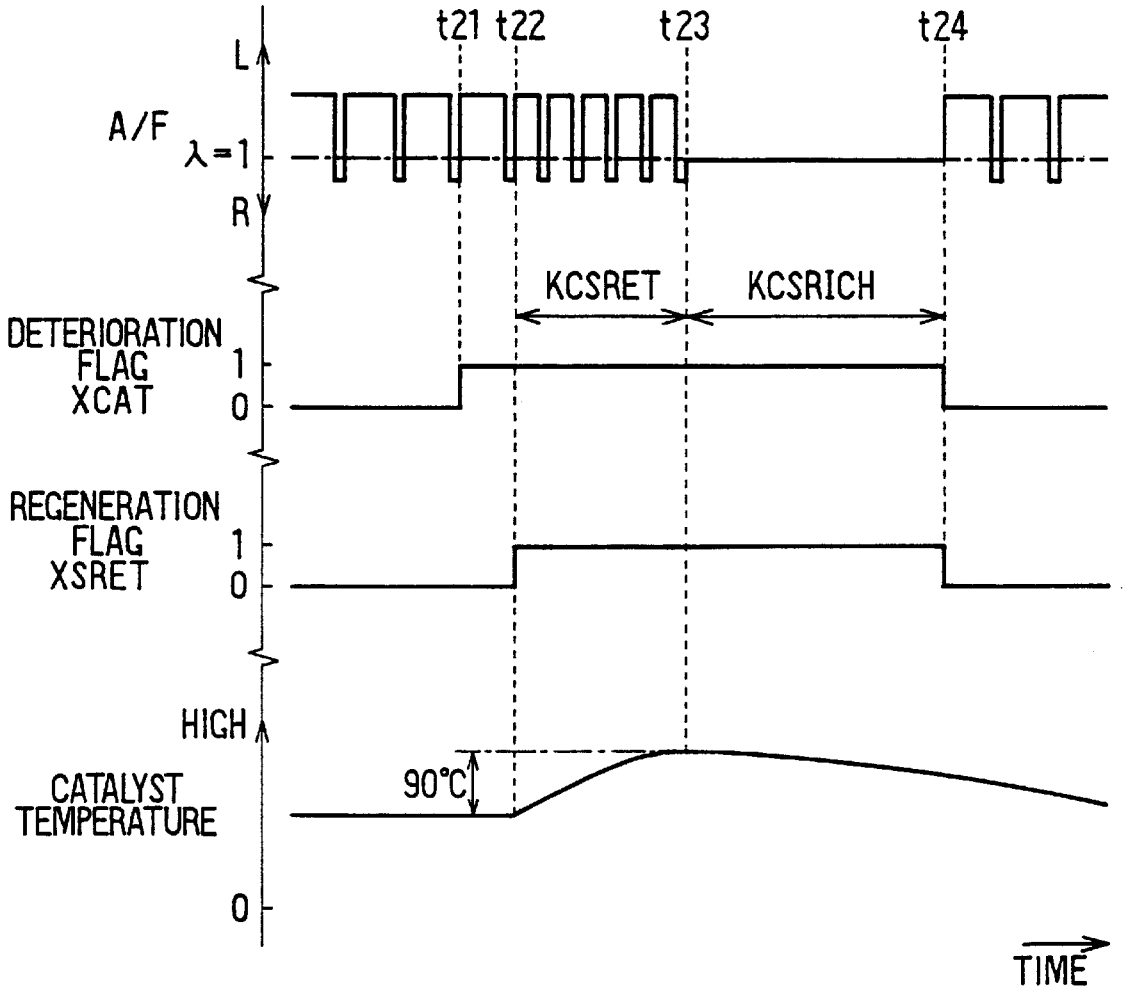
FIG. 19 is a timing diagram showing the catalyst regenerating operation in the first embodiment.

The control operation will be described by using the timing diagram of FIG. 19. In FIG. 19, before time t21, a normal lean/rich combustion control is executed. For example, the lean combustion control and the rich combustion control are repeatedly executed at the time ratio of, for instance, "50:1". In accordance with the processing of FIGS. 9 and 10, the processing for detecting the deterioration of the NOx catalyst 14 is executed on the basis of the NOx purification ratio on each occasion.

When the occurrence of the catalyst deterioration is detected at time t21, "1" is set to the deterioration detection flag XCAT (step 411 in FIG. 10). After that, the catalyst regenerating processing in FIG. 16 is started at time t22, and "1" is set to the regenerating processing flag XSRET in association with the execution of the catalyst regenerating processing (step 704 in FIG. 16). After time t22, the lean combustion control and the rich combustion control are repeatedly executed at the time ratio of "5:1" (step 707 in FIG. 16).

When the proportion of the rich combustion control is increased at time t22, the rich components (unburned HC) in exhaust gases become rather excessive. Consequently, the quantity of heat generated when the unburned HC is oxidized in the NOx catalyst 14 increases and the catalyst temperature rises. In case of the embodiment, by increasing the proportion of the rich combustion control to "5:1", the temperature rise to about 90° C. is implemented.

After starting the regenerating processing, at time t23 when a time corresponding to the predetermined value KCSRET is elapsed, the control at the stoichiometric ratio in which the target air-fuel ratio AFTG is set to "1.0" is started (step 710 in FIG. 16).

After that, at time t24 when a time corresponding to the predetermined value KCSRICH is elapsed, the regenerating processing flag XSRET is cleared to "0", and the normal airfuel ratio control in which the time ratio between the lean combustion control and the rich combustion control is set to "50:1" is re-started.

After time t24, the catalyst deterioration detecting processing of FIGS. 9 and 10 is newly executed and whether the NOx occluding power of the NOx catalyst 14 has recovered or not is determined. When the NOx occluding power has recovered by this time, the deterioration detection flag XCAT is cleared to "0" as shown in the diagram. On the contrary, when the NOx occluding power has not recovered yet, the deterioration detection flag XCAT is held at "1".

When the processing of FIG. 18 is executed after the regenerating processing and the NOx occluding power has not recovered (XCAT=1), "1" is set to the malfunction occurrence flag XSDGLMP (not shown). Further, the malfunction indicator light is turned on and the driver is warned of the occurrence of a malfunction.

In the embodiment, step 707 in FIG. 16 corresponds to temperature increasing means described in claims and step 710 corresponds to catalyst regenerating means. The processing of FIGS. 9 and 10 correspond to deterioration detecting means.

According to the first embodiment, the following advantages can be obtained.

When the occurrence of deterioration of the NOx catalyst 14 is detected, that is, the NOx occlusion amount of the NOx catalyst 14 decreases below the predetermined value, the proportion of the rich combustion to the lean combustion is increased to allow the catalyst temperature to rise. After the rise of the catalyst temperature, the air-fuel ratio is controlled to the stoichiometric ratio ($\lambda$=1) to regenerate the NOx catalyst 14. In this case, different from a conventional system, the lean misfire and retardation in the ignition timing are not forcefully performed, so that unexpected torque fluctuations and deterioration in emission are not caused. As a result, sulfur adsorbed on the NOx catalyst 14 can be properly discharged while avoiding the conventional disadvantages.

By the execution of the regenerating processing of the NOx catalyst 14 as mentioned above, NOx can be properly purified by the catalyst 14 and the exhaust emission can be kept in a good condition.

By executing the regenerating processing of the NOx catalyst 14 when deterioration of the catalyst 14 occurs, even if the catalyst enters a deteriorated state by the poisoning of sulfur, the state can be immediately resolved. By performing the regenerating processing only when the catalyst deteriorates, influence on the other controls such as frequent interruption of the air-fuel ratio lean combustion control can be minimized.

Further, after the execution of the catalyst regenerating processing, whether the NOx occluding power of the NOx catalyst 14 has recovered or not is checked. If the NOx occluding power has not recovered yet, a malfunction of the catalyst is determined. For example, when the NOx catalyst is subjected to high heat and heat deteriorated, even if the regenerating processing is performed, the NOx occluding power does not recover. In such a case, therefore, the occurrence of the malfunction is determined and warned to urge parts replacement or the like.

According to the processing for detecting the catalyst deterioration shown in FIGS. 9 and 10, the NOx occluding power can be accurately determined while reflecting how rich exhaust gases supplied to the NOx catalyst 14 become or how high the rich degree becomes. The deterioration of the NOx catalyst 14 can be therefore accurately detected.

The first embodiment of the invention can be modified as follows.

Figure 20B:
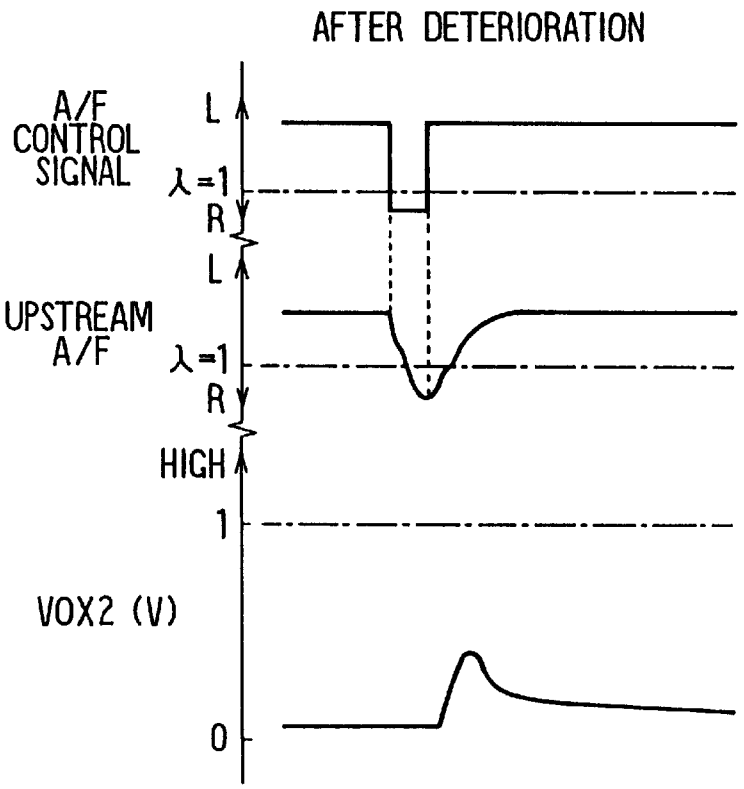
FIGS. 20A and 20B are diagrams showing sensor output waveforms before and after the catalyst deterioration.
Figure 20A:
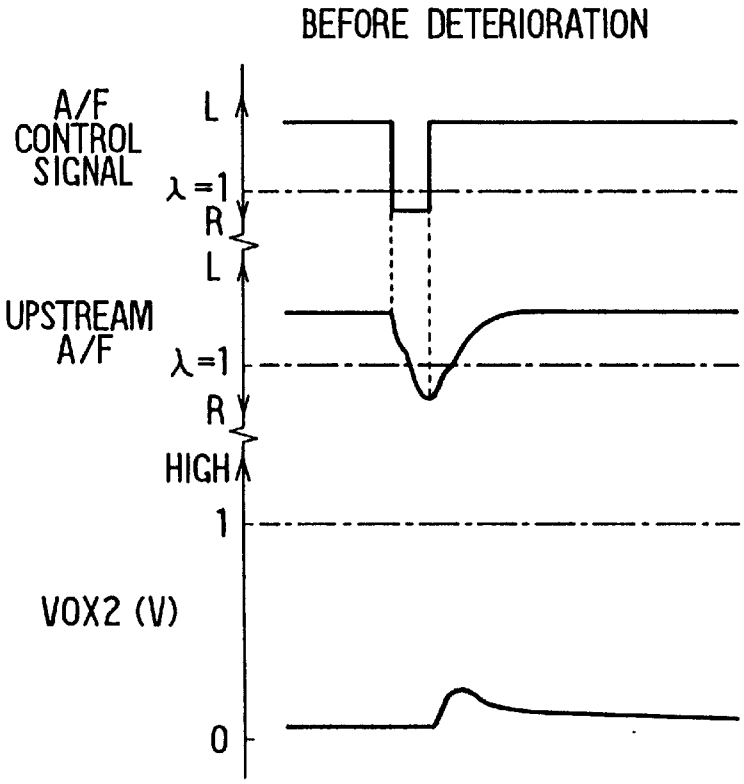

Although the deterioration of the NOx catalyst 14 is detected according to the processing of FIGS. 9 and 10 in the foregoing embodiment, the detection can be changed. The NOx occluding power of the NOx catalyst 14 is estimated based on the rear $O_2$ sensor output VOX2 (output of the $O_2$ sensor 27 downstream of the catalyst) at the time of the rich combustion and the degree of the catalyst deterioration is detected from the NOx occluding power. More specifically, the NOx occluding power of the NOx catalyst 14 is estimated on the basis of the peak value of the rear $O_2$ sensor output VOX2, time integrated value (area), or locus. That is, as shown in FIG. 20, when the degree of deterioration of the NOx catalyst 14 differs, for example, the peak value of the rear $O_2$ sensor output VOX2 differs. Since the peak value of FIG. 20B is larger than that of FIG. 20A, it can be determined that the catalyst deterioration has become worse.

On the other hand, as long as exceptional irregularities do not occur, it can be considered that the catalyst deterioration becomes worse at about the same speed with elapse of time. It is therefore regarded that the NOx occluding power is purified at a time point when a predetermined time has elapsed or the vehicle travels a predetermined distance and the catalyst regenerating processing is performed.

In the foregoing embodiment, after execution of the catalyst regenerating processing (processing of FIG. 16), whether the NOx occluding power has recovered or not is determined. If the NOx occluding power has not recovered yet, it is regarded that the catalyst enters an un-regenerable state such as heat deterioration and the occurrence of a malfunction is determined. Such a construction can be changed. When it is determined that the NOx occluding power has not recovered yet after completion of the catalyst regenerating processing, the catalyst regenerating processing is performed again and, after that, whether the NOx occluding power has recovered or not is determined again (the maximum number of execution times of the regenerating processing is set to about 10). When the regenerating processing is executed a plurality of times in the following regenerating processing, the efficiency of the regenerating processing can be improved by increasing the catalyst temperature rise width by shortening the time ratio between the lean combustion control and the rich combustion control (FIG. 18).

Figure 21:
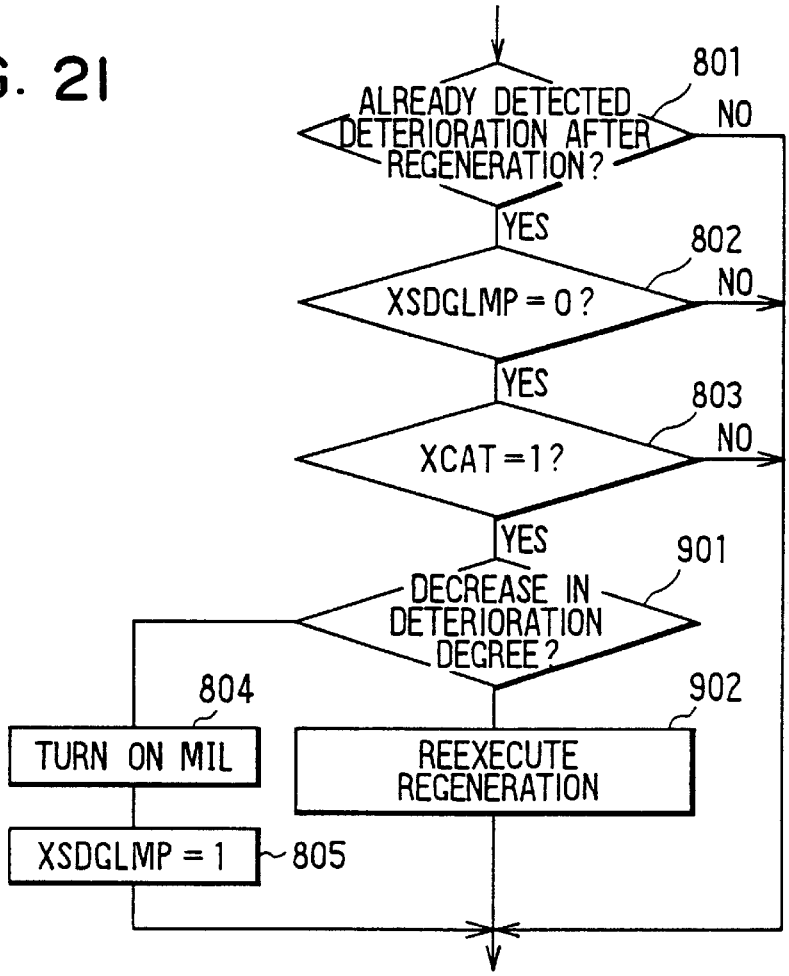
FIG. 21 is a flow diagram showing processing of a modification of the first embodiment.

Whether or not there is a change in the degree of the catalyst deterioration (NOx occluding power) between before and after the regenerating processing is determined. When the catalyst deterioration degree is decreased, since there is the possibility of regeneration, re-execution of the regenerating processing is permitted. If the catalyst deterioration degree has not changed, it is regarded that there is no possibility of regeneration and the occurrence of a malfunction is determined finally (the regenerating processing is not continued). In this case, the catalyst regenerating processing which is more reliable can be implemented. Specifically, the processing of FIG. 21 are executed. The processing of FIG. 21 are obtained by changing a part of the processing of FIG. 17 and only different points from FIG. 17 will be described hereinbelow. To be specific, after execution of steps 801 to 803, at step 901, the CPU 31 determines whether the degree of the catalyst deterioration has decreased or not on the basis of values of the deterioration degree stored before and after the regenerating processing. When the degree of catalyst deterioration has not decreased, occurrence of a malfunction is determined (steps 804 and 805). If the degree of catalyst deterioration has decreased, the CPU 31 advances to step 902 and re-executes the catalyst regenerating processing (processing of FIG. 16).

In case of performing the catalyst regenerating processing, it is also possible to use the degree of richness at the time of the rich combustion control as the air-fuel ratio control parameter and increase the degree of richness to thereby increase the catalyst temperature. The catalyst temperature can be also increased by using both parameters of the time ratio between the lean time and the rich time and the degree of richness. In short, as long as the catalyst temperature can be increased by variably setting the ratio between the lean combustion and the rich combustion, any construction can be employed. In any of the cases, a desired catalyst temperature increasing action can be obtained while avoiding the unexpected torque fluctuations and deterioration of the emission as described above.

[Second Embodiment]

Figure 22:
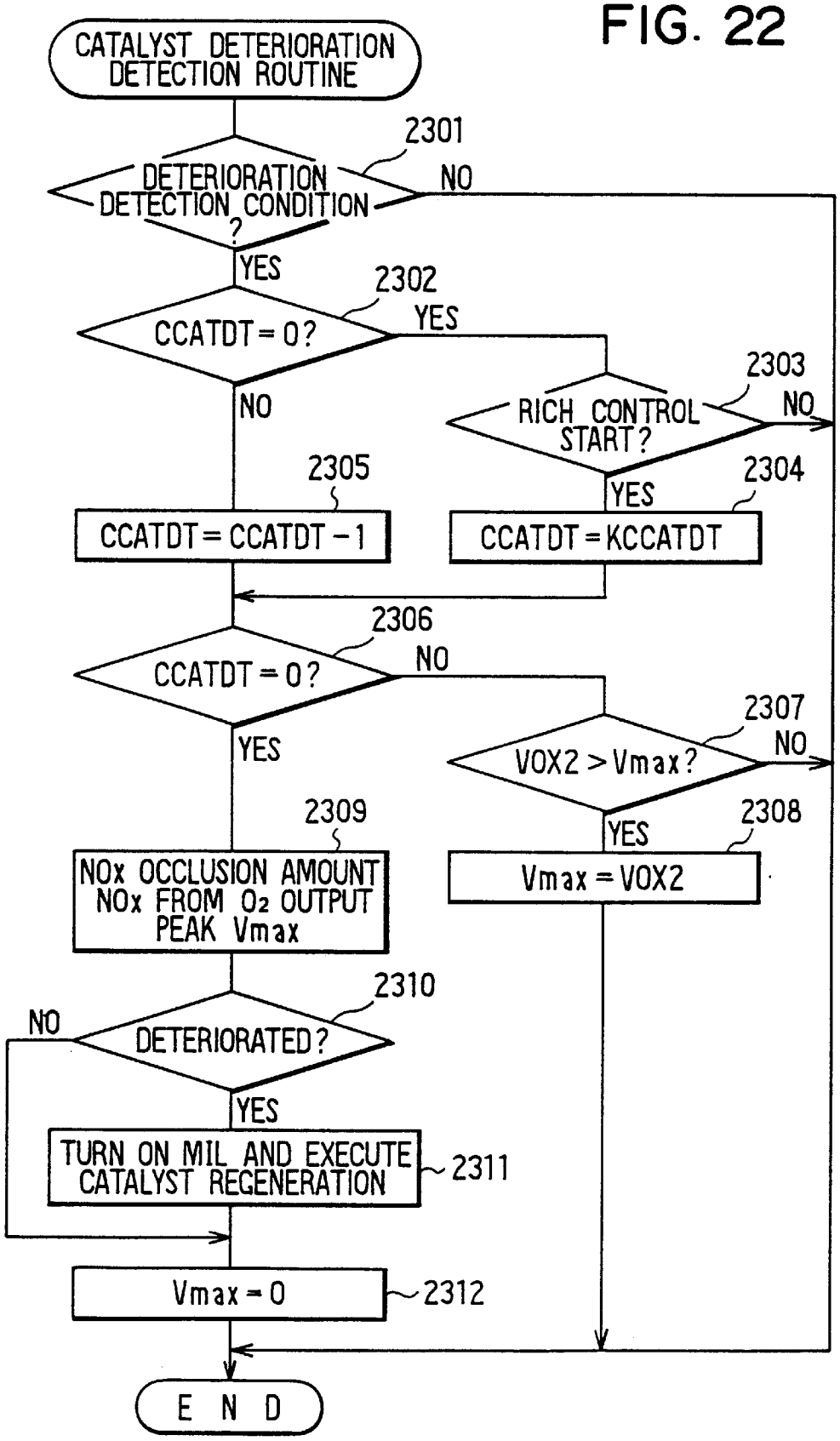
FIG. 22 is a flow diagram showing a catalyst deterioration detection routine according to a second embodiment of the present invention.

In the second embodiment, the catalyst deterioration detection is implemented as shown in FIG. 22.

Figure 24A:
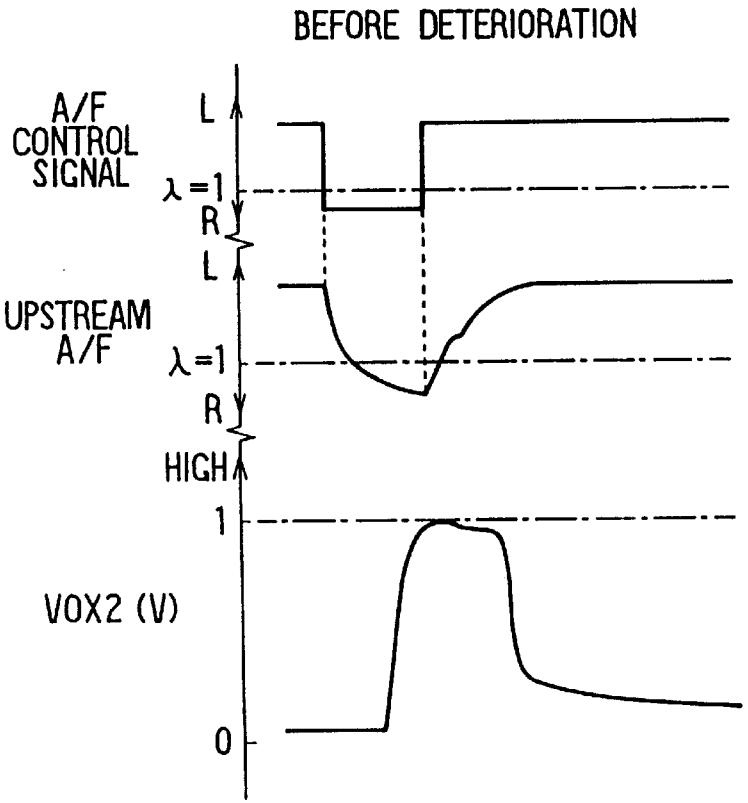
FIGS. 24A and 24B are diagrams showing sensor output waveforms before and after the catalyst deterioration.
Figure 24B:
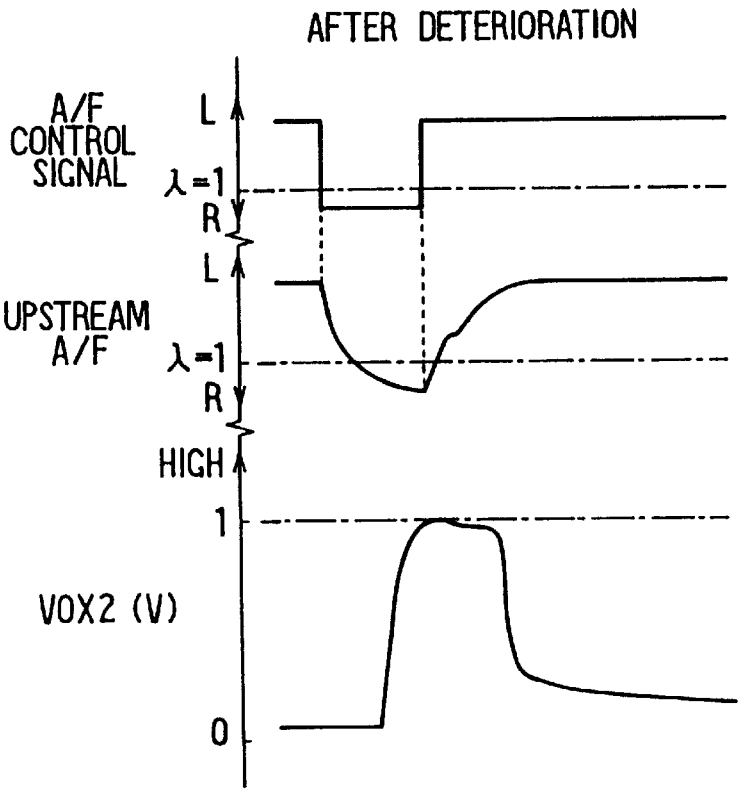

First at step 2301, the CPU 31 determines whether requirements for executing the deterioration detection are satisfied or not. The requirements for executing the deterioration detection include that the rich time is shorter than a predetermined time. For example, in the state of FIG. 20, since the peak value of the rear $O_2$ sensor output VOX2 can be determined, the requirements are satisfied. In the state of FIG. 24, since the peak value of the rear $O_2$ sensor output VOX2cannot be determined, the requirements are not satisfied. Requirements for execution as listed below may be also included.

The degree of richness is within a predetermined range.

The lean time or the rich time in the event of the lean combustion is within a predetermined range.

It is in a steady operating state where the catalyst temperature is around 350° C.

When the above execution requirements are satisfied, the CPU 31 advances to step 2302. When they are not met, the routine is finished once immediately.

After that, the CPU 31 determines whether the counter CCATDT is "0" or not at step 2302. On condition that CCATDT=0, the CPU 31 proceeds to step 2303. The CPU 31 determines whether it is the timing of start of the rich combustion control or not at step 2303. If YES at step 2303, the CPU 31 advances to step 2304 and sets the predetermined value "KCCATDT" to the counter CCATDT. It is sufficient to set the predetermined value KCCATDT to time about three times as long as the rich time TR.

For example, at time t2 in FIG. 6, the CPU 31 determines that it is the start timing of the rich combustion control (YES) at step 2303 and the predetermined value KCCATDT is set at time t2. If NO at step 2303, the CPU 31 ends the routine immediately.

When the predetermined value KCCATDT is set in the beginning of the rich combustion control start as mentioned above, the CPU 31 determines as NO at step 2302 from the next time on. The CPU 31 decrements the counter by "1" at step 2305 and proceeds to step 2306.

The CPU 31 determines whether the counter CCATDT indicates "0" or not at step 2306. IF CCATDT≠0, the CPU 31 advances to step 2307 and determines whether the rear $O_2$ sensor output VOX2 is larger than the value vmax which is the maximum until the previous time. If VOX2>Vmax, the CPU 31 advances to step 2308 and updates the maximum value Vmax to the rear $O_2$ sensor output VOX2 at that time. If VOX2≦Vmax, the CPU 31 ends the routine immediately. That is, by repeatedly executing steps 2307 and 2308, the peak value of the rear $O_2$ sensor output VOX2 can be obtained.

On the other hand, when CCATDT=0 and YES at step 2306, the CPU 31 advances to step 2309 and estimates the NOx occlusion amount of the NOx catalyst 14 on the basis of the calculated maximum value Vmax (rear $O_2$ sensor output peak value) of the rear $O_2$ sensor output. At this time, it is estimated in such a manner that the larger the rear $O_2$ sensor output maximum value Vmax is, the smaller the NOx occlusion amount is.

Figure 23:
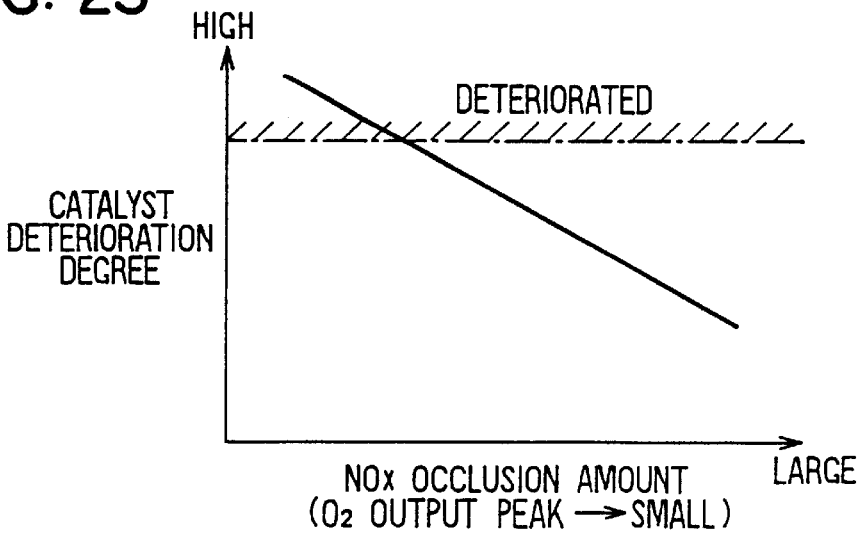
FIG. 23 is a map showing the relation between the NOx occlusion amount and the catalyst deterioration degree.

After that, at step 2310, the CPU 31 determines the degree of deterioration of the NOx catalyst 14 on the basis of the estimated NOx occlusion amount by using the relation of FIG. 23. FIG. 23 shows the relation such that as the estimated NOx occlusion amount increases (as the rear $O_2$ sensor output peak value decreases), the catalyst deterioration degree becomes lower and, on the contrary, as the NOx occlusion amount decreases (as the rear $O_2$ sensor output peak value increases), the catalyst deterioration degree becomes higher. In this case, in the slashed line region of FIG. 23, the occurrence of deterioration is determined.

When the occurrence of deterioration is determined at step 2310, the CPU 31 turns on the MIL (malfunction indicator light) at step 2311 to warn the driver of the occurrence of a malfunction and executes the regenerating processing for recovering the NOx occlusion power. Finally, the CPU 31 clears the maximum value Vmax of the rear $O_2$ sensor output to "0" at step 2312 and ends the routine.

In the regenerating processing at step 2311, for instance, a processing for resolving the sulfur poisoning which is the main cause of the catalyst deterioration is carried out. Since the regenerating processing is not the gist of the case, its detailed description is omitted, but the outline will be described briefly. The temperature of the NOx catalyst 14 (catalyst temperature) is raised by increasing the proportion of the rich combustion which is executed in the lean combustion and the control at the stoichiometric ratio with the air-fuel ratio of $\lambda=1$ or the slightly rich side control is performed. When the rich components (HC, CO) are supplied to the NOx catalyst 14 in a state where the temperature of the catalyst 14 is high, sulfate $BaSO_4$ formed by the sulfur poisoning is purified and sulfur is discharged. Thus, the NOx catalyst 14 is regenerated.

When the deterioration state of the NOx catalyst 14 is continuously detected irrespective of the catalyst regenerating processing, it is regarded that the catalyst 14 is in an un-regenerable state and the occurrence of a malfunction is determined finally. When the occurrence of the malfunction is determined finally, the lean combustion control after that is inhibited and, for example, the stoichiometric ratio control at the air-fuel ratio $\lambda=1$ is executed. After the occurrence of the malfunction is determined finally, the MIL can be turned on.

In the embodiment, the NOx occlusion power of the NOx catalyst 14 is estimated on the basis of the peak value of the rear $O_2$ sensor output VOX2 at the time of the rich combustion and the deterioration of the catalyst 14 is detected based on the estimated NOx occlusion power. With this construction, the NOx occlusion power can be precisely determined while reflecting how rich the exhaust gases supplied to the NOx catalyst 14 become or how high the degree of richness becomes. In this case, even if a very small amount of rich components flows to the downstream of the catalyst and the sensor output value changes to the rich side before the occluded NOx is purified as the air-fuel ratio becomes rich, proper sensor output information according to the state of the catalyst deterioration on each occasion can be obtained. As a result, the deterioration of the NOx catalyst 14 can be accurately detected.

The requirements for executing the deterioration detection are set and, for example, only when the rich time is shorter than a predetermined value, the NOx occluding power is estimated. In this case, by performing the deterioration detection only when the rich gas amount is smaller than the predetermined value, the reliability can be increased.

[Third Embodiment]

Figure 25:
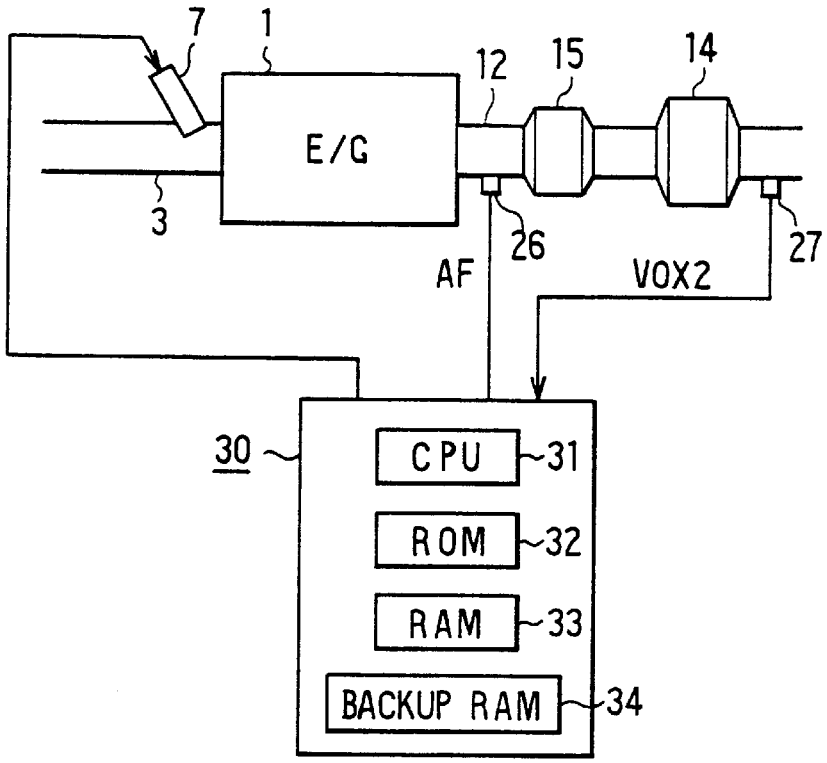
FIG. 25 is a schematic block diagram showing a third embodiment of the present invention.

As shown in FIG. 25, in this embodiment, a three-way catalyst 15 functioning as a start catalyst is disposed upstream of the NOx catalyst 14. More specifically, the three-way catalyst 15 has a capacity smaller than that of the NOx catalyst 14, is activated at an early stage after low-temperature starting of the engine 1, and purifies harmful gases. The A/F sensor 26 is disposed upstream of the three-way catalyst 15 and the $O_2$ sensor 27 is provided downstream of the NOx catalyst 14.

In this case, the upstream three-way catalyst 15 temporarily stores oxygen in exhaust gases at the time of the lean combustion. The rich components (HC, CO) and the stored oxygen in the three-way catalyst 15 therefore react with each other at the time of the rich combustion. After completion of the reaction, the rich components are supplied to the NOx catalyst 14. The oxygen storing power of the three-way catalyst 15 changes according to the degree of deterioration of the three-way catalyst 15. It is known that, for example, when the catalyst deterioration proceeds, the oxygen storing power is lessened.

Figure 26:
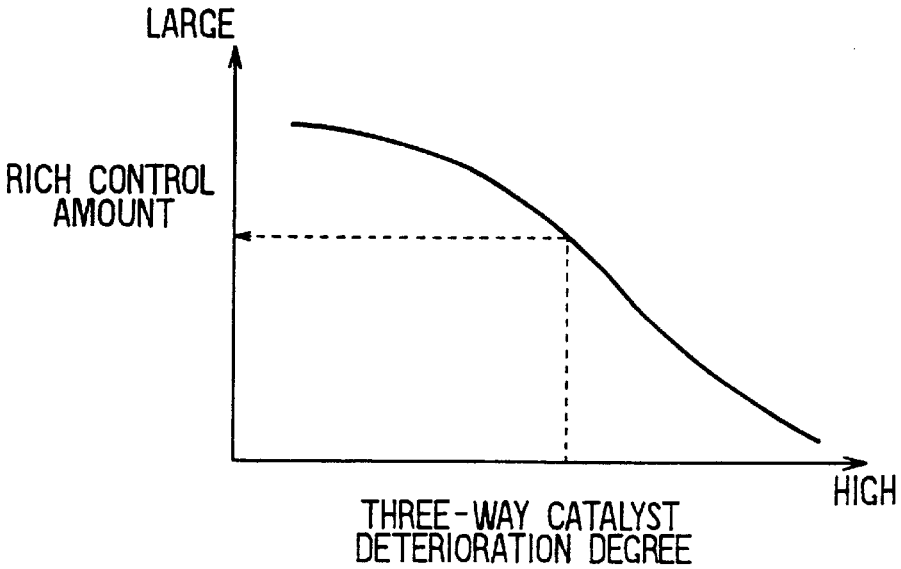
FIG. 26 is a graph showing the relation between a three-way catalyst deterioration degree and a rich control amount.

In the embodiment, the degree of deterioration of the three-way catalyst 15 is detected and the control at the rich air-fuel ratio is performed according to the degree of the catalyst deterioration. In such a case, the CPU 31 determines the rich combustion control amount in accordance with the catalyst deterioration degree on each occasion by using the relation of FIG. 26. In FIG. 26, when the catalyst deterioration degree is low, the oxygen storing power of the three-way catalyst 15 is high, so that a relatively large rich combustion control amount is set. That is, continuation time of the rich combustion control is set to be relatively long. When the catalyst deterioration degree is high, the oxygen storing power of the three-way catalyst 15 is low, so that a relatively small rich combustion control amount is set. That is, the continuation time of the rich combustion control is set to be relatively short.

When the rich combustion control amount (rich time) is set according to the deterioration degree of the three-way catalyst 15 as mentioned above, a predetermined amount of rich gases can be always supplied to the NOx catalyst 14. Therefore, the deterioration of the catalyst 14 can be detected based on the rear $O_2$ sensor output VOX2. In this case, the degree of deterioration of the NOx catalyst 14 is detected in accordance with the peak value of the rear $O_2$ sensor output VOX2 at the time of the rich combustion by using the catalyst deterioration detecting processing of FIGS. 9 and 10.

As a method of detecting the degree of deterioration of the three-way catalyst 15, for example, a method disclosed in JP-A No. 8-338286 by the applicant of the present invention can be applied. The catalyst deterioration detecting method will be briefly described. The CPU 31 executes a sub feedback control so that the rear $O_2$ sensor output VOX2 (output of the $O_2$ sensor 27 downstream of the catalyst) coincides with the target value and an integrated value of the deviation of the rear $O_2$ sensor output VOX2 is obtained. The degree of deterioration of the three-way catalyst 15 is detected based on the integrated value of the VOX2 deviation. In this case, the smaller the integrated value of the VOX2 deviation is, the higher catalyst deterioration degree is detected.

Figure 27A:
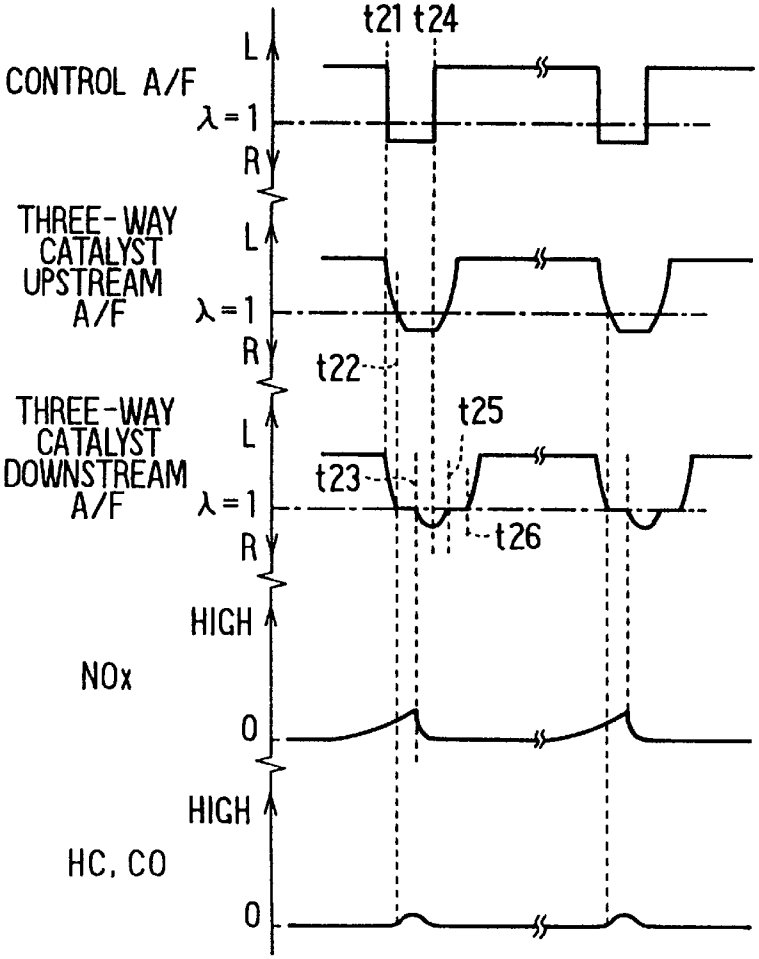
FIGS. 27A and 27B are timing diagrams showing catalyst deterioration detecting operation in the third embodiment.
Figure 27B:
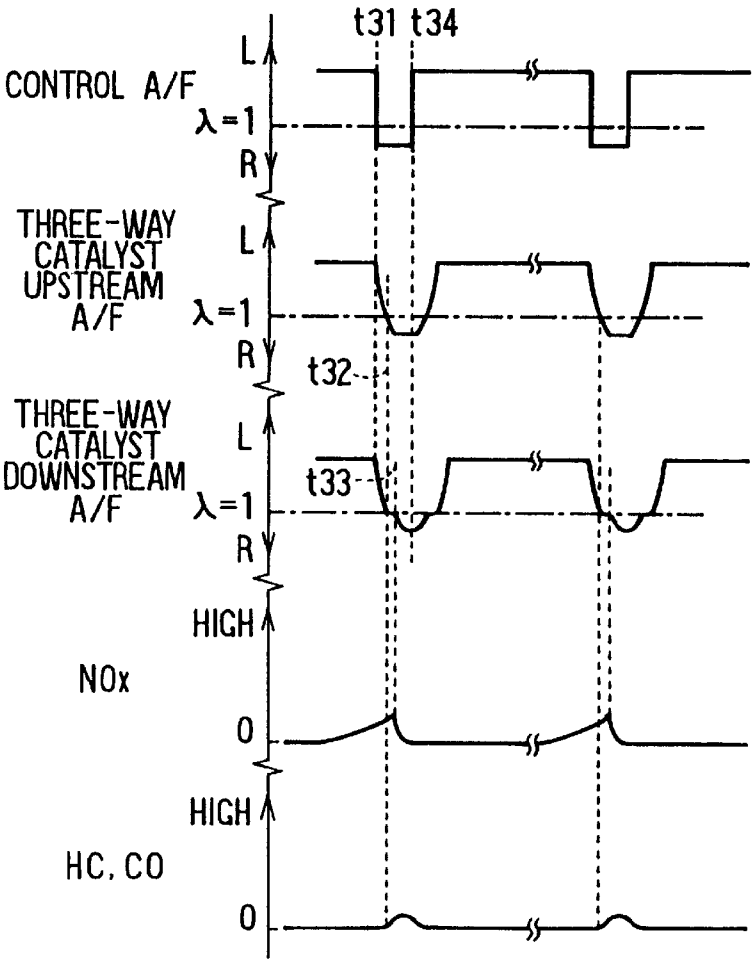

The operation of the embodiment will be described with reference to timing diagrams of FIGS. 27A and 27B. FIGS. 27A and 27B show changes of the air-fuel ratio and the like with respect to the case where the three-way catalyst 15 is new and the case where the catalyst 15 deteriorates. At time t21 in FIG. 27A, continuation time of the rich combustion control is set based on the degree of deterioration of the three-way catalyst 15 at that time and the rich combustion control is started according to the continuation time.

After that, at time t22, the air-fuel ratios upstream and downstream of the three-way catalyst 15 reach the stoichiometric air-fuel ratio ($\lambda$=1). Although the air-fuel ratio upstream of the three-way catalyst 15 immediately shifts to the rich side relative to the stoichiometric ratio, the oxygen stored at the time of the lean combustion control exists in the three-way catalyst 15, so that the stored oxygen and the rich components (HC, CO, and the like) in the exhaust gases react with each other and the air-fuel ratio downstream of the three-way catalyst 15 is held once at the stoichiometric ratio. After completion of the reaction between the stored oxygen and the rich components, the air-fuel ratio downstream of the three-way catalyst 15 shifts to the rich side (time t23). After time t23, the rich components are supplied to the side of NOx catalyst 14, so that NOx occluded in the catalyst 14 is purified and discharged.

At time t24, the lean combustion control is re-started, the air-fuel ratio downstream of the three-way catalyst 15 is held at the stoichiometric ratio only for a predetermined period (time t25 to t26) during which the lean components in the exhaust gases supplied from the upstream side and the rich components stored in the catalyst 15 react with each other, and then the air-fuel ratio returns to the lean combustion control value.

On the other hand, when the three-way catalyst 15 deteriorates, as shown in FIG. 27B, the air-fuel ratio is switched from the lean side to the rich side at time t31 and the continuation time of the rich combustion control is set based on the degree of deterioration of the three-way catalyst 15. In this case, since the deterioration of the three-way catalyst 15 has become worse, a relatively small rich combustion control amount is given (FIG. 26).

At time t32 when the air-fuel ratios upstream and downstream of the three-way catalyst 15 reach the stoichiometric ratio ($\lambda$=1), the air-fuel ratio downstream of the three-way catalyst 15 is held once at the stoichiometric ratio. Since the three-way catalyst 15 has deteriorated, the amount of oxygen stored in the catalyst is small and the air-fuel ratio shifts to the rich side more quickly than the case of FIG. 27A (time t33). That is, the time from t32 to t33 in FIG. 27B during which oxygen stored in the three-way catalyst 15 and the rich components in the exhaust gases react with each other is shorter than the time from t22 to t23 in FIG. 27A. After time t33, the rich components are supplied to the NOx catalyst 14 side, so that NOx occluded in the catalyst 14 is purified and discharged. After that, the air-fuel ratio is returned to the lean value at time t34.

According to FIGS. 27A and 27B, the rich time is controlled according to the degree of deterioration of the three-way catalyst 15. Consequently, at the time of the rich combustion control, irrespective of the presence or absence of the deterioration of the three-way catalyst 15, a necessary amount of rich gases is always supplied and the rich gas amount downstream of the NOx catalyst 14 can be regulated at a value by which the deterioration of the catalyst can be detected.

Although the three-way catalyst 15 is provided upstream of the NOx catalyst 14 in the third embodiment, in a manner similar to the foregoing embodiments, the deterioration of the NOx catalyst 14 can be also accurately detected.

In the embodiment, by disposing the A/F sensor 26 upstream of the three-way catalyst 15, the distance between the engine 1 and the sensor 26 is shortened and the response time from the air-fuel ratio changed to the sensor output change is shortened. Consequently, the sensor accuracy at the time of transient operation can be increased.

[Fourth Embodiment]

Figure 28:
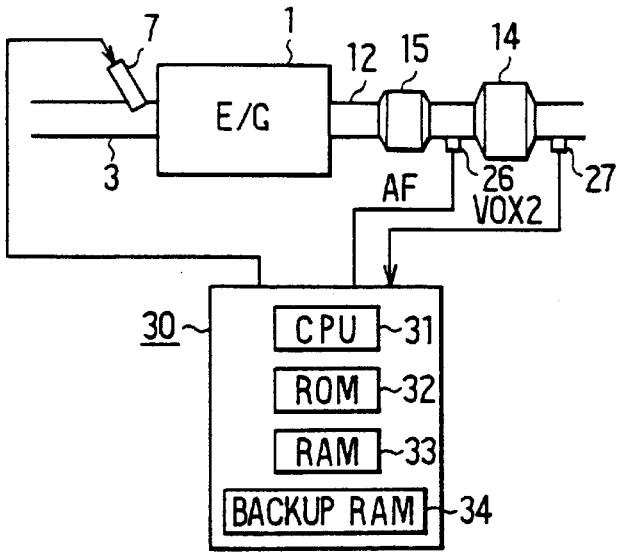
FIG. 28 is a block diagram showing a fourth embodiment of the present invention.

In a fourth embodiment, in a manner similar to the third embodiment, the three-way catalyst 15 as a start catalyst is provided upstream of the NOx catalyst 14 and the air-fuel ratio control system is constructed as shown in FIG. 28. The difference of FIG. 28 from FIG. 25 is that the A/F sensor 26 is provided downstream of the three-way catalyst 15 (between the catalysts 14 and 15) in FIG. 28.

In the third embodiment, as described in the second embodiment, the degree of deterioration of the catalyst 14 is detected on the basis of the NOx purification ratio of the NOx catalyst 14. That is, the NOx integrated amount CNOXAD flowing in the NOx catalyst 14 is calculated according to the processing of FIG. 7. In accordance with the processing of FIGS. 9 and 10, the actual rich gas amount (rich gas integrated value AFAD−rear $O_2$ sensor output integrated value VOX2AD) required to purify NOx in the NOx catalyst 14 is calculated and the degree of deterioration of the NOx catalyst 14 is detected according to the NOx purification ratio which is obtained by "AFAD−VOX2AD/CNOXAD".

In case of using the NOx purification ratio as a deterioration determining parameter, the catalyst deterioration can be detected without regulating the rich gas amount flowing in the NOx catalyst 14 to a predetermined value. Consequently, the processing for detecting the deterioration of the three-way catalyst 15 and regulating the rich combustion control amount in accordance with the result of the detection as described in the third embodiment is unnecessary.

With the construction, even if the oxygen storing power varies according to the degree of deterioration of the three-way catalyst 15 as described above, irrespective of the oxygen storing power, the NOx purification ratio can be accurately obtained from the actual rich gas amount required to purify NOx and the NOx inflow amount at the time of the lean combustion. That is, without being influenced by the degree of deterioration of the three-way catalyst 15, the deterioration of the NOx catalyst 14 can be accurately detected.

[Fifth Embodiment]

Although the three-way catalyst 15 having the oxygen storing power is disposed upstream of the NOx catalyst 14 in the third and fourth embodiments, in the fifth embodiment, the three-way catalyst is changed to a catalyst having no oxygen storing power or a low oxygen storing power. In the fifth embodiment, the three-way catalyst is constructed by carrying only a noble metal (platinum Pt) having no oxygen storing power on a carrier. Specifically, a catalyst layer in which only platinum Pt is deposited on the surface of porous alumina $Al_2O_3$ is coated on a carrier made of stainless steel or ceramics such as cordierite.

In such a case, the oxygen stored in the three-way catalyst 15 and the rich components (HC, CO) in the exhaust gases do not react with each other, so that the rich component supply amount to the downstream side does not decrease by an amount corresponding to the reaction. The movements of the air-fuel ratios upstream and downstream of the three-way catalyst 15 almost coincide with each other. As the foregoing third embodiment, therefore, the processing for variably setting the rich combustion control amount according to the degree of deterioration of the three-way catalyst 15 becomes unnecessary. The methods of detecting the deterioration of the NOx catalyst 14 according to FIG. 22 and FIGS. 9 and 10 are applicable.

The embodiments of the invention can be also modified as follows.

Although the deterioration detection using the rear $O_2$ sensor output VOX2 is executed only when the deterioration detection executing requirement that the lean time TL and the rich time TR are relatively short is satisfied, the construction can be changed. For example, the deterioration detection is executed in a predetermined time cycle and the lean time TL and the rich time TR are forcefully shortened when the deterioration detection is performed. That is, when the NOx occluding power is estimated and the catalyst deterioration is detected by the estimation value, the rich time or the degree of richness at the time of the rich combustion is regulated to a predetermined value or smaller. With the construction, the rear $O_2$ sensor output VOX2 when the catalyst is not deteriorated and that when the catalyst deteriorates become clearly different, and as a result, very reliable catalyst deterioration detection can be implemented.

Although the NOx occluding power of the NOx catalyst 14 is estimated according to the peak value of the rear $O_2$ sensor output VOX2 and the deterioration of the catalyst 14 is detected on the basis of the NOx occluding power in the first embodiment, it can be changed as described in (1) and (2).

(1) The NOx occluding power is estimated from a time integrated value (area) of the VOX2 change and the catalyst deterioration is detected based on the NOx occluding power. Specifically, the rear $O_2$ sensor output integrated value VOX2AD is calculated based on the rear $O_2$ sensor output VOX2 at the time of the rich combustion control and the NOx occluding power is estimated according to the rear $O_2$ sensor output integrated value VOX2AD. In this case, it can be regarded that the larger the VOX2AD value becomes, the more the NOx occluding power of the NOx catalyst 14 decreases and the deterioration of the catalyst 14 proceeds.

(2) The amount of change every unit time of the rear $O_2$ sensor output VOX2 is integrated at the time of the rich combustion control, thereby obtaining the locus of output values. The NOx occluding power is estimated from the locus of VOX2 and the catalyst deterioration is detected based on the NOx occluding power. In this case, it can be regarded that the larger the locus of VOX2 is, the more the NOx occluding power of the NOx catalyst 14 decreases and the deterioration of the catalyst 14 proceeds.

The $O_2$ sensor 27 is disposed downstream of the NOx catalyst 14 and the deterioration of the NOx catalyst 14 is detected by using an output of the sensor 27 (rear $O_2$ sensor output VOX2) in the foregoing embodiments. The $O_2$ sensor 27 can be changed to a limit current type A/F sensor and the deterioration of the catalyst is detected by using the A/F sensor output as described in (A) and (B).

(A) The catalyst deterioration is detected from the peak value of the output of the A/F sensor 27 disposed downstream of the NOx catalyst 14 or the output time integrated value (area). It is sufficient to perform the detection according to the processing of FIG. 7 by changing the rear $O_2$ sensor output VOX2 used at steps 2307 to 2309 in FIG. 22 to a "rear A/F sensor output".

(B) In the processing of FIGS. 9 and 10, the integrated value of outputs of the A/F sensor downstream of the catalyst is calculated instead of the rear $O_2$ sensor output integrated value VOX2AD. That is, the integrated value of outputs of the A/F sensor is calculated as a surplus gas amount on the downstream side of the catalyst. In this case, the NOx purification amount (the rich gas amount required to purify NOx) in the NOx catalyst 14 is calculated from the difference between the integrated value of outputs of the A/F sensor upstream of the catalyst at the time of the rich combustion and the integrated value of outputs of the A/F sensor downstream of the catalyst at the time of the rich combustion. The catalyst deterioration is detected according to the NOx purification amount.

Figure 29:
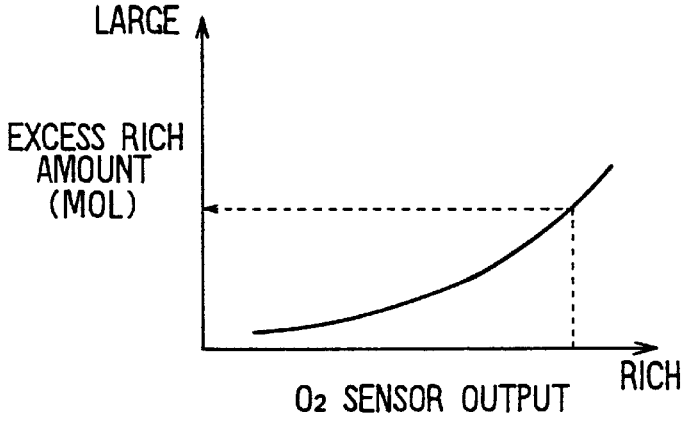
FIG. 29 is a graph showing the relation between the $O_2$ sensor output and the excess rich amount.
Figure 30:
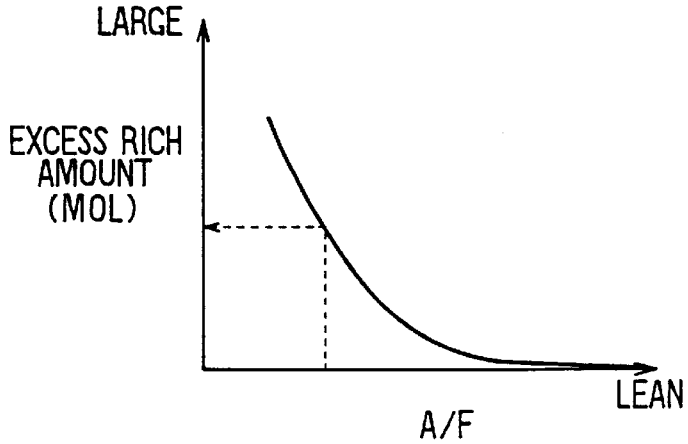
FIG. 30 is a graph showing the relation between the air-fuel ratio and the excess rich amount.

The outputs of the $O_2$ sensor and the A/F sensor 27 are used to be converted to physical quantities. For example, by using the relation of FIG. 29, the output of the $O_2$ sensor is converted into an excess rich quantity (mol) and the deterioration of the NOx catalyst 14 is detected by using any of the data of the peak value of the excess rich amount, time integrated value (area), and locus. Alternatively, the output of the A/F sensor is converted into the excess rich quantity (mol) by using the relation of FIG. 30 and the deterioration of the NOx catalyst 14 is detected by using any of the data of the peak value of the excess rich amount, time integrated value (area), and locus.

The method of detecting the deterioration of the three-way catalyst 15 in the third embodiment can be changed. For example, the method disclosed in JP-A No. 9-31612 by the applicant of the invention is applied. In the method, an amount of gas components to be treated in the catalyst (data reflecting an untreated gas component amount) during the period of time from starting of the engine until the three-way catalyst is warmed up is calculated and the degree of deterioration of the three-way catalyst is detected based on the untreated gas component amount. In this case, the catalyst deterioration can be detected with high precision while considering increase in the exhaust emission before activation of the catalyst. Before the three-way catalyst is warmed up, the difference of the purification ratios depending on the difference of the degree of catalyst deterioration is large and the catalyst deterioration can be easily and accurately detected.

In the fifth embodiment, the following construction can be applied as the three-way catalyst 15 having a low oxygen storing power.

The three-way catalyst is formed by carrying no co-catalyst having a high oxygen storing power or a small amount of the co-catalyst on a carrier. In this case, as a co-catalyst having a high oxygen storing power, ceria $CeO_2$, barium Ba, lanthanum La, and the like are known.

The three-way catalyst is formed by using a small carrying amount of a noble metal (Rh, Pd) having oxygen storing power. Especially, it is preferable to use 0.2 g/lit. or smaller in case of rhodium Rh and 2.5 g/lit. or smaller in case of palladium Pd.

The present invention described above should not be limited to the disclosed embodiments and modifications, but may be implemented in other ways without departing from the spirit and scope of the invention. For instance, the disclosed catalyst deterioration detection may be used to separately from the catalyst temperature increasing operation and the catalyst regenerating operation.

What is claimed is:

1. An exhaust purification system for an internal combustion engine having a NOx catalyst, which is provided in an exhaust system of the internal combustion engine and has a function of occluding NOx discharged from the internal combustion engine and purifying the occluded NOx when an air-fuel ratio is at a stoichiometric ratio or on a rich side, the system comprising:

temperature increasing means for increasing temperature of the NOx catalyst by variably setting an air-fuel ratio control parameter for controlling the air-fuel ratio to be alternately lean and rich with respect to the stoichiometric ratio when a NOx occlusion amount which can be occluded by the NOx catalyst is lower than a predetermined value;

catalyst regenerating means for regenerating the NOx catalyst by controlling the air-fuel ratio to the stoichiometric ratio or to the rich side after temperature increasing operation;

deterioration detecting means for detecting deterioration of the NOx catalyst, wherein the temperature increasing means and the catalyst regenerating means are operative when the deterioration of the NOx catalyst is detected;

an oxygen concentration sensor which is disposed downstream of the NOx catalyst and senses concentration of oxygen in exhaust gases, wherein the deterioration detecting means includes estimating means for estimating a NOx occluding power of the NOx catalyst based on an output of the oxygen concentration sensor when the air-fuel ratio is on the rich side, and the deterioration of the catalyst is detected based on the estimated NOx occluding power of the NOx catalyst;

wherein the deterioration detecting means includes NOx purification ratio calculating means for calculating a NOx purification ratio of the NOx catalyst from the ratio between the NOx amount flowing in the NOx catalyst at the time of the lean combustion control and the rich gas amount required to purify NOx by the NOx catalyst at the time of the rich combustion control, and detects the deterioration of the NOx catalyst on the basis of the calculated NOx purification ratio, an upstream sensor which is provided upstream of the NOx catalyst and senses concentration of oxygen in the exhaust gases; and a downstream sensor which is provided downstream of the NOx catalyst and senses the concentration of oxygen in the exhaust gases, wherein the NOx purification ratio calculating means includes:

means for calculating an inflow amount A of NOx flowing in the NOx catalyst at the time of the lean combustion control on the basis of the sensing result of the upstream sensor;

means for calculating an inflow amount B of rich gas flowing in the NOx catalyst at the time of the rich combustion control on the basis of the sensing result of the upstream sensor; and means for calculating an amount C of excess rich gases emitted from the NOx catalyst at the time of the rich combustion control on the basis of the sensing result of the downstream sensor, and the NOx purification ratio calculating means calculates the NOx purification ratio based on the calculated NOx inflow amount A at the time of the lean combustion control, the rich gas inflow amount B and the surplus gas amount C.

2. An exhaust purification system for an internal combustion engine having a NOx catalyst, which is provided in an exhaust system of the internal combustion engine and has a function of occluding NOx discharged from the internal combustion engine and purifying the occluded NOx when an air-fuel ratio is at a stoichiometric ratio or on a rich side, the system comprising:

temperature increasing means for increasing temperature of the NOx catalyst by variably setting an air-fuel ratio control parameter for controlling the air-fuel ratio to be alternately lean and rich with respect to the stoichiometric ratio when a NOx occlusion amount which can be occluded by the NOx catalyst is lower than a predetermined value;

catalyst regenerating means for regenerating the catalyst by controlling the air-fuel ratio to be stoichiometric ratio or to the rich side after a temperature increasing operation; and malfunction determining means for determining means for determining whether a NOx occluding power of the NOx catalyst has recovered or not after the execution of the regenerating operation by the catalyst regenerating means and, when the NOx occluding power has not recovered yet, determines that the NOx catalyst is in malfunction;

wherein said regenerating operation eliminates deterioration of NOx catalyst due to sulfur poisoning and a malfunction determination by said malfunction determining means indicates deterioration of said NOx catalyst that is not caused by sulfur poisoning.

3. An exhaust purification system for an internal combustion engine having a NOx catalyst, which is provided in an exhaust system of the internal combustion engine and has a function of occluding NOx discharged from the internal combustion engine and purifying the occluded NOx when an air-fuel ratio is at a stoichiometric ratio or on a rich side, the system comprising:

temperature increasing means for increasing temperature of the NOx catalyst by variably setting an air-fuel ratio control parameter for controlling the air-fuel ratio to be alternately lean and rich with respect to the stoichiometric ratio when a NOx occlusion amount which can be occluded by the NOx catalyst is lower than a predetermined value;

catalyst regenerating means for regenerating the catalyst by controlling the air-fuel ratio to be stoichiometric ratio or to the rich side after temperature increasing operation; and malfunction determining means for determining whether or not there is a change in a NOx occluding amount of the NOx catalyst before and after regenerating operation by the catalyst regenerating means, permitting re-execution of the regenerating processing when the NOx occluding amount has increased, and determining that the NOx catalyst is in malfunction when the NOx occluding power has not changed wherein said regenerating operation eliminates deterioration of NOx catalyst due to sulfur poisoning and a malfunction determination by said malfunction determining means indicates deterioration of said NOx catalyst that is not caused by sulfur poisoning.

* * * * *